US010006106B2

(12) United States Patent
Tameda et al.

(10) Patent No.: US 10,006,106 B2
(45) Date of Patent: Jun. 26, 2018

(54) BRASS ALLOY AND PROCESSED PART AND WETTED PART

(71) Applicant: KITZ CORPORATION, Chiba (JP)

(72) Inventors: Hidenobu Tameda, Nagano (JP); Hisanori Terui, Nagano (JP); Kei Ito, Nagano (JP); Tomoyuki Ozasa, Nagano (JP)

(73) Assignees: KITZ CORPORATION, Chiba (JP); KITZ METALWORKS CORPORATION, Nagano (JP)

( * ) Notice: Subject to any disclaimer, the term of this patent is extended or adjusted under 35 U.S.C. 154(b) by 0 days. days.

(21) Appl. No.: 14/439,505

(22) PCT Filed: Apr. 8, 2013

(86) PCT No.: PCT/JP2013/060652
§ 371 (c)(1),
(2) Date: Apr. 29, 2015

(87) PCT Pub. No.: WO2014/069020
PCT Pub. Date: May 8, 2014

(65) Prior Publication Data

US 2015/0275333 A1 Oct. 1, 2015

(30) Foreign Application Priority Data

Oct. 31, 2012 (JP) ..... 2012-241138

(51) Int. Cl.
*C22C 9/04* (2006.01)

(52) U.S. Cl.
CPC ..... *C22C 9/04* (2013.01)

(58) Field of Classification Search
CPC ..... C22C 9/04
See application file for complete search history.

(56) References Cited

U.S. PATENT DOCUMENTS 5,942,056 A * 8/1999 Singh ..... C22C 9/00 148/434
6,942,742 B2 * 9/2005 Yamagishi ..... C22F 1/08 148/433

(Continued)

FOREIGN PATENT DOCUMENTS

JP 54-38219 3/1979
JP 54-67518 5/1979

(Continued)

OTHER PUBLICATIONS

"Glossary of Metallurgical and Metalworking Terms," Metals Handbook, ASM International, 2002, term(s): machinability, machining.*

(Continued)

*Primary Examiner* — Scott Kastler
*Assistant Examiner* — Vanessa T Luk
(74) *Attorney, Agent, or Firm* — Wenderoth, Lind & Ponack, L.L.P.

(57) ABSTRACT

Provided is a brass alloy excellent in recyclability and corrosion resistance while avoiding the addition of Bi and Si, and with which machinability is ensured and processing is facilitated with preventing inclusion of lead. The present invention includes at least 58.0 to 63.0 mass % of Cu, 1.0 to 2.0 mass % of Sn and 0.05 to 0.29 mass % of Sb and the remainder composed of Zn and unavoidable impurities. With the present invention, stress corrosion crack resistance and machinability are improved. 0.05 to 1.5 mass % of Ni is included in a copper alloy to improve stress corrosion crack resistance as a result of the interaction between Ni and Sb. Furthermore, 0.05 to 0.2 mass % of P is included to improve anti-dezincification properties.

9 Claims, 11 Drawing Sheets

(56) References Cited

U.S. PATENT DOCUMENTS

| | | | | |
|---|---|---|---|---|
| 8,366,840 | B2 * | 2/2013 | Tameda | C22C 9/04 148/433 |
| 2003/0095887 | A1 * | 5/2003 | Dong | C22C 9/04 420/470 |
| 2004/0241038 | A1 * | 12/2004 | Hofmann | C22C 9/04 420/472 |
| 2006/0225816 | A1 * | 10/2006 | Kurose | C22C 9/04 148/432 |
| 2007/0158002 | A1 * | 7/2007 | Oishi | B22D 21/025 148/434 |
| 2008/0253924 | A1 | 10/2008 | Oishi | |
| 2011/0064602 | A1 * | 3/2011 | Lo | C22C 9/04 420/471 |

FOREIGN PATENT DOCUMENTS

| | | | |
|---|---|---|---|
| JP | 61-213333 | | 9/1986 |
| JP | 10-152735 | | 6/1998 |
| JP | 10183275 | A * | 7/1998 |
| JP | 2005-105405 | | 4/2005 |
| JP | 3734372 | | 10/2005 |
| JP | 3917304 | | 2/2007 |
| JP | 4225540 | | 12/2008 |
| WO | 2006/016621 | | 2/2006 |

OTHER PUBLICATIONS

"Glossary of Metallurgical and Metalworking Terms," Metals Handbook, ASM International, 2002, term(s): casting, continuous casting, impurities.*

International Search Report dated Jun. 4, 2013 in International (PCT) Application No. PCT/JP2013/060652.

S. Sohn et al., "The Effects of Tin and Nickel on the Corrosion Behavior of 60Cu—40Zn Alloys", Journal of Alloys and Compounds, vol. 335, pp. 281-289, 2002.

* cited by examiner

Fig. 20

Result of gap jet corrosion test

| Material | Photograph of corroded | Mass loss (mg) | Maximum corrosion depth (μm) | Corrosion form |
|---|---|---|---|---|
| Test material 69 | | 240 | 16 | Bedded corrosion |
| Test material 71 | | 120 | 33 | Bedded corrosion |
| C3771 | | 620 | 480 | Cyclic corrosion |

BRASS ALLOY AND PROCESSED PART AND WETTED PART

TECHNICAL FIELD

The present invention relates to a brass alloy, particularly to a brass alloy which is used as an alloy material of water supply instruments such as valves, couplings and the like, and to a processed part and a wetted part.

Background Art

In recent year, when a water supply instrument such as a valve, a coupling and the like for water piping is made of a brass alloy, for example, a lead-free brass alloy is mainly used for preventing elution of lead as a toxic metal, and wherein, other components are contained as an alternative for lead to ensure properties such as machinability, corrosion resistance and the like. In this case, as a lead-free brass alloy largely for water supply instruments, three kinds of alloys: a bismuth-based alloy containing Bi as a free-machining additive, a silicon-based alloy containing Si as a free-machining additive and a 40/60 brass alloy containing no free-machining additive and mostly composed of copper and zinc (hereinafter, referred to as 40/60 brass alloy), are predominantly in practical use.

As the bismuth-based lead-free brass alloy, for example, there is a suggestion on a lead-less brass material for forging in Patent document 1. In this brass material, machinability is improved by inclusion of Bi as an alternative for lead. Further, Patent document 2 suggests valves for a sluice valve for water piping in which elution of lead is suppressed by use of a brass alloy containing Bi.

As the silicon-based lead-free brass alloy, for example, free-machining copper alloys described in Patent document 3 and Patent document 4 are suggested. In these copper alloys, Si is contained while preventing inclusion of lead in copper, trying to obtain satisfactory machinability.

PRIOR ART DOCUMENTS

Patent Documents

Patent document 1: JP-A No. 2005-105405
Patent document 2: Japanese Patent No. 4225540
Patent document 3: Japanese Patent No. 3734372
Patent document 4: Japanese Patent No. 3917304

SUMMARY OF THE INVENTION

Problem to be Solved by the Invention

However, when free-machining additives such as Bi, Si and the like are mixed in a lead-containing brass, various defects occur, therefore, the content thereof is strictly controlled. For example, Si is conventionally known as a contraindicated element, and we should pay meticulous attention to contamination in a production process, and additionally, production in the same equipment is very difficult. Also for Bi, its control criterion is strict, and from the standpoint of a problem of intermediate temperature embrittlement, mixing of Pb into a bismuth-based lead-free brass becomes severer than mixing of Bi into a lead-containing brass.

From these reasons, alloys prepared by mixing free-machining additives such as Bi, Si and the like are problematical in recyclability. As a result, copper alloys containing Bi and Si are sometimes taken over by a smelter and the like at price cheaper significantly than the original value, after deviating from the recycle system, and this is reflected in product price in some cases because of difficult recycling.

In contrast, a 40/60 brass alloy, among lead-free brass alloys, is recycled relatively easily because of no inclusion of Bi and Si, however, problematic in corrosion resistance. In general, the corrosion resistance problematic in brasses includes stress corrosion crack resistance and a dezincification corrosion resistance, and of them, especially stress corrosion crack resistance is problematic in a lead-free brass, and often lower than that in a lead-containing brass. The reason for this is that stress corrosion crack resistance is ensured by Pb in a lead-containing brass alloy, while Pb is scarcely contained in the case of a lead-free 40/60 brass alloy.

Further, in the case of use with soft water having strong corrosiveness, also a dezincification corrosion resistance is required, and in the case of use in instruments regulating flow rate via small aperture, also an anti-erosion-corrosion resistance is required in some cases.

For solving this, for example, a naval brass having seawater resistance improved by adding about 0.5 to 1.5% of Sn, further, a brass having a dezincification corrosion resistance improved by adding As to this naval brass, and the like, are known as the 40/60 brass alloy endowed with corrosion resistance. In any of these alloys, however, stress corrosion crack resistance is lower than lead-containing brasses and sufficient practicability is not obtained in many cases. Further, As is known to show strong toxicity on organisms, and inclusion of this As in an alloy material for water supply instruments tends to be not acceptable by manufactures and users in general.

The present invention has been intensively investigated in view of the above-described current conditions, resulting in the development thereof, and its object is to provide a brass alloy excellent in recyclability and corrosion resistance while avoiding the addition of Bi and Si, and with which machinability is ensured and processing is facilitated with preventing inclusion of required lead and allowing inclusion of a small amount of lead.

Means for Solving the Problem

For attaining the above-described object, the present invention is a brass alloy comprising at least 58.0 to 61.9 mass % of Cu, 1.0 to 2.0 mass % of Sn and 0.05 to 0.29 mass % of Sb and the remainder composed of Zn and unavoidable impurities, wherein this brass alloy is allowed to contain 0.3 mass % or less of Pb, thereby enabling recyclability with a copper alloy containing Pb and also giving excellent machinability and stress corrosion crack resistance.

Another present invention is a brass alloy comprising at least 58.0 to 61.9 mass % of Cu, 1.1 to 2.0 mass % of Sn and 0.05 to 0.29 mass % of Sb and the remainder composed of Zn and unavoidable impurities, wherein this brass alloy contains 0.05 to 1.5 mass % of Ni and interaction by addition of this Ni and the above-described Sb is generated, thereby suppressing segregation of Sn and Sb in γ-phase to improve stress corrosion crack resistance.

The brass alloy, wherein the above-described Sb is contained at a content of 0.05 to 0.15 mass %, and stress corrosion crack resistance is excellent while reducing the content of the Sb.

The brass alloy, wherein the above-described brass alloy contains 0.10 to 0.25 mass % of Ni, and lowering of hot ductility is prevented while ensuring stress corrosion crack resistance.

The brass alloy, wherein the above-described brass alloy contains 0.05 to 0.15 mass % of P, thereby improving dezincification corrosion resistance and machinability.

A processed part obtained by processing-molding the brass alloy of the present invention to be used in a processed part.

A wetted part (water contact part) obtained by using the brass alloy of the present invention in a wetted part such as a valve and the like.

Effect of the Invention

According to the present invention, by inclusion of Sn and Sb at prescribed proportions instead of lead, machinability is ensured and processing is facilitated while preventing inclusion of required lead and allowing inclusion of a small amount of lead, the addition of Bi and Si of which content should be controlled strictly is avoided and recyclability is improved, corrosion resistance such as stress corrosion crack resistance, a dezincification corrosion resistance, an anti-erosion-corrosion resistance and the like equivalent to the case of inclusion of Bi and Si is improved, thus, this corrosion resistance can be stabilized.

Additionally, by inclusion of Ni in prescribed proportion, interaction between Ni and Sb is generated, thereby further improving stress corrosion crack resistance, and corrosion resistance can be stabilized.

Further, by addition of P, a dezincification corrosion resistance is ensured and corrosion resistance can be improved, and a cutting property improves since chips can be crushed by this addition of P.

BRIEF EXPLANATION OF DRAWINGS

FIG. 20 is an explanation view showing the results of a gap jet corrosion test.

MODES FOR CARRYING OUT THE INVENTION

Figure 1:
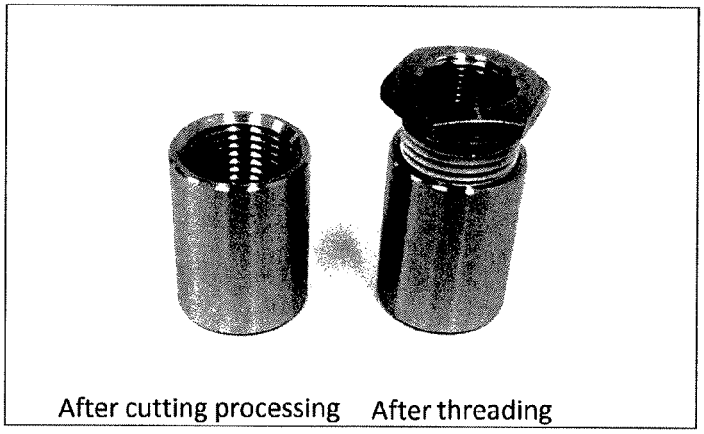
FIG. 1 is a photograph showing the appearance of a test piece.

The brass alloy excellent in recyclability and corrosion resistance of the present invention will be illustrated in detail based on embodiments below.

The brass alloy of the present invention is a brass alloy excellent in recyclability and corrosion resistance, comprising at least 58.0 to 63.0 mass % of Cu, 1.0 to 2.0 mass % of Sn and 0.05 to 0.29 mass % of Sb and the remainder composed of Zn and unavoidable impurities.

It is desirable that Ni is contained at a content of 0.05 to 1.5 mass % with respect to this copper alloy.

Further, this brass alloy may contain 0.05 to 0.2 mass % of P.

The elements contained in the brass alloy of the present invention and their desirable composition ranges, and reasons thereof will be illustrated.

Sn: 1.0 to 2.0 Mass %

Sn is an element for improving corrosion resistance such as stress corrosion crack resistance (SCC resistance), a dezincification corrosion resistance, an anti-erosion-corrosion resistance and the like of a brass alloy, and in the present invention, is an essential element to improve mainly SCC resistance. To improve SCC resistance by causing deposition of γ-phase by inclusion of Sn, a content of 1.0 mass % or more is necessary. To ensure SCC resistance equivalent to or more than that of a lead-containing brass such as C3771, C3604 and the like, inclusion at a content of 1.1 mass % or more utilizing a synergistic effect of Sb and Ni described later is desirable, and when contained at a content of 1.4 mass % or more, SCC resistance can be ensured while placing much value particularly on hot workability of a forged valve having relatively large caliber, a thin forged article and the like. In contrast, inclusion of Sn possibly hardens an alloy, lowers mechanical properties (particularly, elongation) and thus deteriorates reliability of the product, therefore, the content of inclusion is 2.0 mass % or less, more preferably 1.8 mass % or less. When placing much value particularly on cold workability, the content of inclusion is 1.3 mass % or less, and for obtaining excellent cold workability, the content of inclusion is desirably 1.6 mass % or less.

Sb: 0.05 to 0.29 Mass %

Sb is known as an element for improving the dezincification corrosion resistance and SCC resistance of a brass alloy. In the present invention, Sb is an essential element to improve and stabilize SCC resistance together with inclusion of Sn described later, further, to improve dramatically SCC resistance by a synergistic effect with Ni. For improving a dezincification corrosion resistance and SCC resistance, inclusion at a content of 0.05 mass % is necessary, and the effect is surely obtained by inclusion at a content of 0.07 mass % or more. On the other hand, since these effects are saturated when included excessively, the minimally necessary content for obtaining corrosion resistance is 0.15 mass %, more preferably 0.10 mass % in terms of the upper limit.

Further, Sb is known as an element to improve the machinability of a brass alloy by inclusion thereof at content of 0.3 to 2.0 mass %, and in the present invention, on the premise of deposition of γ-phase by inclusion of 1.0 mass % or more of Sn, it is possible to obtain an effect of improving machinability (particularly, a property of crushing chips) by solid-solving Sb in this γ-phase even if the content of Sb is 0.29 mass % or less. By this, reduction of elongation by generation of an intermetallic compound due to excess inclusion of Sb can be prevented. The effect of improving machinability is obtained at a content of at least 0.07 mass % or more. In examples described below, the content of Sb is around 0.07 to 0.10 mass %. Since inclusion of Sb at a content of over 0.10 mass % needs special consideration regarding safety, values around this are suitable as valid data showing SCC resistance taking account of marketability.

Ni: 0.05 to 1.5 Mass %

Ni is known as an element to improve the mechanical properties and corrosion resistance of a brass alloy. Though there is a general idea that Ni exerts some effect on SCC resistance, is has been clarified that SCC resistance lowers when Ni is contained in an alloy composed of 40/60 brass+Sn (naval brass) as bases as described below. In contrast, when Ni is contained in an alloy composed of 40/60 brass+Sn+Sb as bases, SCC resistance is improved in a range of Sn: 1.0 to 2.0 (preferably, Sn: 1.1 to 1.6) mass % and Sb: 0.05 to 0.29 (preferably, Sb: 0.08 to 0.10), that is, the presence of a synergistic effect by Sb and Ni on SCC resistance has become clear. By this, it becomes possible to dramatically improve and stabilize SCC resistance, and to decrease the content of Sn which lowers elongation. The effect of improving SCC resistance of Ni is obtained by inclusion at a content of 0.05 mass % or more, and becomes surer by inclusion at a content of 0.10 mass % or more. On the other hand, since excess inclusion thereof lowers machinability and the like by generation of a hard intermetallic compound, the upper limit thereof is 1.5 mass %, more preferably 1.0 mass %, and since Ni is also an element to lower hot ductility, it is recommendable that the upper limit is 0.5 mass %, more preferably 0.25 mass %.

Cu: 58.0 to 63.0 mass %

A brass product is produced via processes of hot working (hot extrusion, hot forging) and cold working (drawing). Further, mechanical properties, machinability, corrosion resistance and the like are required as material properties depending on the use.

The content of Cu is determined in consideration of these facts, and the Cu content should be regulated in a normal situation depending on the contents of Sn, Ni, Sb and P added into a brass alloy for various purposes, while in the present invention, the ranges of components are determined approximately as described below.

It is generally known that the cold workability of a brass rod stabilizes and cold working can be carried out at a content of Cu of about 58.0 mass % or more. Regarding hot workability, it is generally known to be important to regulate the Cu content so that the proportion of β-phase showing high deforming ability at about 600 to 800° C. is 60% or more and less than 100%. The upper limit of the Cu content satisfying such conditions is 63.0 mass %, more preferably 62.5 mass %.

It is recommendable that the content is 61.9 mass % or less for obtaining stable hot workability and improving machinability. Especially in use for hot forging, the upper limit thereof should be about 61.0 mass %, and for ensuring more excellent hot forgeability, the content is advantageously 60.8 mass % or less.

In use for cold working, the lower limit thereof is advantageously 59.2 mass % since excellent elongation should be ensured, and for obtaining further excellent cold workability, the lower limit is advantageously 61.0 mass % or more. Further, for obtaining a more excellent dezincification corrosion resistance, the lower limit is advantageously 60.0 mass %.

P: 0.05 to 0.2 Mass %

P is an element publicly-known as an element to improve the dezincification corrosion resistance of brass. When there is a need for a strict dezincification corrosion resistance against the maximum dezincification corrosion depth of 200 μm or the like in an anti-dezincification corrosion test according to ISO6509-1981, inclusion of P is essential together with inclusion of Sb in the inventive alloy. The effect of improving a dezincification corrosion resistance of P is obtained by inclusion thereof at a content of 0.05 mass % or more, and more infallibly, a content of 0.08 mass % or more is advantageous. On the other hand, excess inclusion thereof lowers particularly hot workability by generation of a hard intermetallic compound, therefore, the upper limit thereof is advantageously 0.2 mass %.

P is an element which improves machinability (particularly, a property of crushing chips) by generation of the above-described intermetallic compound, and a remarkable effect is obtained when the content of P is around 0.08 mass % at which the intermetallic compound is generated. Though the effect of improving machinability increases together with an increase in the content of P, it is recommendable that the upper limit thereof is 0.15 mass %, more preferably 0.10 mass % in consideration of also a decrease in the above-described hot workability.

Pb: 0.3 Mass % or Less

If the upper limit of Pb is managed strictly, use of limited melting materials is forced, leading to a cause of increased cost of an alloy, therefore it is desirable that a certain amount is allowed from the standpoint of recyclability. On the other hand, since Pb is harmful on a human body, it is desirable to reduce the amount of Pb as much as possible, and it is desirable that the upper limit of Pb is 0.3 mass % or less, though varying depending on the product shape, on the presumption of accomplishment of NSF61-Section8-Annex F which is one of criteria of elution into tap water. Since inclusion of Pb is permitted up to 0.25 mass % in terms of weighted average of wetted components (water contact components) according to NSF61-Annex G which is one of regulations on inclusion of Pb, it is desirable that the upper limit of lead is 0.25 mass % if complying with this regulation. If 4 mass % which is a tentative criterion charged by RoHs is abolished, there is a high possibility that the upper limit of Pb is 0.1 mass %. As a result, when used in electric and electronic parts and the like, the upper limit of Ph is desirably 0.1 mass %. Further, when registration of CDA as an anti-bacterial material is considered, the upper limit thereof is desirably 0.09 mass %.

Bi: 0.3 Mass % or Less

Though mixing of Bi into a Pb-containing general material such as C3771 and the like should be avoided from the standpoint of recyclability, if the upper limit is strictly controlled, recyclability is deteriorated adversely because of the same reason as for Pb. It is desirable that contents around 0.1 mass % are allowed in a range wherein mixing of C3771 causes no problem, further, it is recommendable that a content of Bi of 0.2 mass % is allowed in view of charging of a return material in an amount of about 50% with respect to the melting weight. In contrast, the upper limit of the Bi content is desirably 0.3 mass % in view of embrittlement by a Bi—Pb eutectic crystal, though varying depending on the content of Pb.

A dezincification corrosion resistance is improved, by inclusion of 0.3 mass % or less of Bi.

Unavoidable Impurities: Fe, Si, Mn

The unavoidable impurities as embodiments of the lead-free brass alloy of the present invention include Fe, Si and Mn. When these elements are contained, adverse effects such as lowering of the cutting property of the alloy due to deposition of a hard intermetallic compound, a resultant increase in the exchange frequency of a cutting tool, and the like are generated. Therefore, Fe: 0.1 mass % or less (when higher corrosion resistance is required, 0.01 mass % or less), Si: 0.1 mass % or less and Mn: 0.03 mass % or less are used as unavoidable impurities exerting a small influence on a cutting property.

In addition, As: 0.1 mass % or less, Al: 0.03 mass % or less, Ti: 0.01 mass % or less, Zr: 0.1 mass % or less, Co: 0.3 mass % or less, Cr: 0.3 mass % or less, Ca: 0.1 mass % or less, B: 0.1 mass % or less, Se: 0.1 mass % or less and Cd: 0.1 mass % or less are listed as unavoidable impurities.

The lead-free brass alloy excellent in recyclability and corrosion resistance of the present invention is constituted based on the above-described elements. Ranges of components desirable as practical chemical components of the brass alloy and ranges of components desirable for dezincification cutting, dezincification forging, general cutting and general forging are summarized in Table 1. The unit of ranges of components is mass %. In the table, Zn as the remainder is omitted, and this remainder includes also unavoidable impurities.

TABLE 1

| | Cemical component of brass alloy (mass %) | | | | | | |
|---|---|---|---|---|---|---|---|
| | Cu | Sn | Sb | Ni | P | Pb | Bi |
| Range of component | 58.0-63.0 | 1.0-2.0 | 0.05-0.29 | 0.05-1.5 | 0.05-0.2 | −0.3 | −0.3 |
| For anti-dezincification cutting | 61.0-61.9 | 1.1-1.6 | 0.08-0.10 | 0.1-0.5 | 0.07-0.15 | −0.25 | −0.1 |
| For anti-dezincification forging | 60.0-61.0 | 1.4-1.6 | 0.08-0.10 | 0.1-0.5 | 0.07-0.15 | −0.25 | −0.1 |
| For general cutting | 59.2-61.0 | 1.1-1.6 | 0.08-0.10 | 0.1-0.5 | −0.04 | −0.25 | −0.1 |
| For general forging | 59.2-61.0 | 1.1-1.8 | 0.08-0.10 | 0.1-0.5 | −0.04 | −0.25 | −0.1 |

*In the table, "−0.3" denotes that the upper limit of ranges of components is 0.3 mass %.

EXAMPLE 1

Next, the stress corrosion crack resistance of the lead-free brass alloy of the present invention was verified. As described above, stress corrosion crack resistance is mentioned as one corrosion resistance, and the following test was conducted for evaluating this stress corrosion crack resistance. Rod-shaped materials (φ26 or more drawn material) were processed by an NC processing machine into φ25×35 (Rcl/2 threaded coupling) shown in FIG. 1, which were used as test pieces of a test material and a comparative material for comparison.

The threading torque of a stainless bushing was controlled to 9.8 N·m (100 kgf·cm), the ammonia concentration was controlled to 14%, and the temperature of a testing room was controlled to around 20° C. In this stress corrosion crack resistance test, a plurality of test materials or comparative materials were prepared from the same material for the following tests, and the tests were carried out. In the stress corrosion crack test, a test piece containing a threaded bushing was placed in a desiccator under an atmosphere having an ammonia concentration of 14%, then, taken out at any time, washed with 10% sulfuric acid, then, observed. The observation is performed using a stereoscopic microscope (7 magnification), and that generating no crack is judged to be ○, that generating fine cracks (½ or less of thickness) is judged to be Δ, that generating cracks of ½ or more of the thickness is judged to be ▲, and that generating thickness-penetrating cracks is judged to be x. For quantitatively representing the judgment after the test, ○ is endowed with three points, Δ is endowed with two points, ▲ is endowed with one point and x is endowed with zero point, numerical values obtained by multiplying the points by the test times are added up for every level, and an evaluation was made in terms of the total point.

For evaluating stress corrosion crack resistance, a lead-containing brass material causing relatively poor stress corrosion crack was used as a comparative material, and this comparative material was used as a criterion. The time level of the stress corrosion crack test includes 4 hours, 8 hours, 16 hours, 24 hours and 48 hours. The chemical component values of a lead-containing brass material are shown in Table 2, the results of the stress corrosion crack resistance test are shown in Table 3, and the results of point evaluation are shown in Table 4. The number of comparative materials in this test was four: comparative materials 1 to 4.

TABLE 2

| Chemical component value of lead-containing brass material (mass %) | | | | | | | | | | |
|---|---|---|---|---|---|---|---|---|---|---|
| Material | Cu | Zn | Pb | Fe | Sn | Ni | P | Se | Bi | Sb |
| Lead-containing brass material | 59.1 | 36.9 | 3.4 | 0.12 | 0.3 | 0.07 | 0.02 | 0.0 | 0.0 | 0.0 |

TABLE 3

| Result of stress corrosion crack resistance test of lead-containing brass material | | | | | | |
|---|---|---|---|---|---|---|
| Material | No. | 4 h | 8 h | 16 h | 24 h | 48 h |
| Lead-containing brass material | Comparative material 1 | Δ | Δ | x | ▲ | x |
| | Comparative material 2 | Δ | ▲ | x | ▲ | x |
| | Comparative material 3 | Δ | ○ | x | x | x |
| | Comparative material 4 | Δ | Δ | x | x | x |

TABLE 4

| Result of point calculation of stress corrosion crack resistance test of lead-containing brass material | | | | | | | | | |
|---|---|---|---|---|---|---|---|---|---|
| Material | No. | 4 h | 8 h | 16 h | 24 h | 48 h | Total point | In the case of full points | Point proportion |
| Lead-containing brass material | Comparative material 1 | 8 | 16 | 0 | 24 | 0 | 144 | 1200 | 12.0% |
| | Comparative material 2 | 8 | 8 | 0 | 24 | 0 | | | |
| | Comparative material 3 | 8 | 24 | 0 | 0 | 0 | | | |
| | Comparative material 4 | 8 | 16 | 0 | 0 | 0 | | | |

From the results of the stress corrosion crack resistance test of lead-containing brass materials (comparative materials 1 to 4), the total point is 144 points, and the point proportion in view of 1200 points as the full points can be calculated as 12.0%, and this is used as a criterion. That is, it is determined that, when the point proportion in conducting the stress corrosion crack resistance test of the lead-free brass alloy of the present invention is 12.0% or more, stress corrosion crack resistance is regarded as approximately excellent.

As a result of the stress corrosion crack resistance test of lead-containing brass materials, thickness-penetrating cracks are generated for the first time at a passage of time of 16 hours, and are not generated at a moment of 8 hours. Therefore, no generation of thickness-penetrating crack at a moment of 8 hours in conducting the stress corrosion crack resistance test is also mentioned as one criterion, and this can be judged to give stable SCC resistance.

According to these facts, the brass alloy excellent in stress corrosion crack resistance provides (1) a point proportion of 12.0% or more when the results of the stress corrosion crack resistance test are judged based on the above-described judgment, and (2) no generation of thickness-penetrating crack at a passage of time of 8 hours in conducting the stress corrosion crack resistance test.

Subsequently, test materials of lead-free brass alloys of the present invention and comparative examples were subjected to a stress corrosion crack test. The method of the test and the results of the test are shown below.

Example 1-1 (Comparative Alloy (1) Containing Sn)

For confirming a stress corrosion crack property when Sn is added, rod-shaped materials produced by using, as a base, 1.5 mass % of Sn shown in the chemical component value in Table 5 were used as test materials. The results of the stress corrosion crack resistance test of these test materials and the point proportions thereof are shown in Table 6. This test was conducted at a test time level of 2 hours, 4 hours, 8 hours, 16 hours, 24 hours and 48 hours.

TABLE 5

| Chemical component value of lead-free brass material (mass %) | | | | | | | | | | |
|---|---|---|---|---|---|---|---|---|---|---|
| Material | Cu | Zn | Pb | Fe | Sn | Ni | P | Se | Bi | Sb |
| Lead-free brass material 1 | 60.3 | 37.0 | 0.2 | 0.00 | 1.5 | 0.00 | 0.00 | 0.0 | 0.0 | 0.00 |
| Lead-free brass material 2 | 59.6 | 37.6 | 0.2 | 0.00 | 1.5 | 0.00 | 0.00 | 0.0 | 0.0 | 0.00 |

TABLE 6

| Result of stress corrosion crack resistance test of lead-free brass material | | | | | | | | | | |
|---|---|---|---|---|---|---|---|---|---|---|
| Material | No. | 2 h | 4 h | 8 h | 16 h | 24 h | 48 h | Total point | In the case of full points | Point proportion (%) |
| Lead-free brass material 1 | Test piece 1 | ▲ | x | Δ | x | x | Δ | 312 | 1224 | 25.5 |
| | Test piece 2 | Δ | x | Δ | x | ▲ | x | | | |
| | Test piece 3 | ○ | Δ | ○ | x | x | x | | | |
| | Test piece 4 | Δ | Δ | ▲ | x | x | Δ | | | |
| Lead-free brass material 2 | Test piece 5 | Δ | x | x | ○ | x | x | 244 | 1224 | 19.9 |
| | Test piece 6 | ▲ | Δ | x | x | ○ | x | | | |
| | Test piece 7 | ▲ | ▲ | x | x | Δ | x | | | |
| | Test piece 8 | Δ | ▲ | x | ○ | x | x | | | |

As a result of the above-described stress corrosion crack resistance test, the point proportions of test materials 1 to 4 and test materials 5 to 8 are 25.5% and 19.9%, respectively, and over 12.0% as the above-described criterion of the point proportion. However, since thickness-penetrating cracks are generated at a moment of 4 hours in any of these test pieces No. 1 to 8, it is not recognized that these test pieces have stable SCC resistance.

Example 1-2 (Comparative Alloy (2) Containing Sn and Ni)

Next, for confirming a stress corrosion crack property when Ni is added, rod-shaped materials obtained by adding Ni to the Sn: 1.5 mass % base material shown in the chemical component value in Table 7 were used as test materials, and these test materials were subjected to a stress corrosion crack resistance test. The results of the stress corrosion crack resistance test of these materials and the point proportions thereof are shown in Table 8. This test was conducted at a test time level of 2 hours, 4 hours, 8 hours, 16 hours, 24 hours and 48 hours.

TABLE 7

| Chemical component value of lead-free brass material (mass %) | | | | | | | | | | |
|---|---|---|---|---|---|---|---|---|---|---|
| Material | Cu | Zn | Pb | Fe | Sn | Ni | P | Se | Pi | Sb |
| Lead-free brass material 3 | 60.2 | 37.1 | 0.2 | 0.01 | 1.5 | 0.18 | 0.00 | 0.0 | 0.0 | 0.00 |
| Lead-free brass material 4 | 60.3 | 37.1 | 0.2 | 0.01 | 1.6 | 0.40 | 0.00 | 0.0 | 0.0 | 0.00 |

TABLE 8

| Result of stress corrosion crack resistance test of lead-free brass material | | | | | | | | | | |
|---|---|---|---|---|---|---|---|---|---|---|
| Material | No. | 2 h | 4 h | 8 h | 16 h | 24 h | 40 h | Total point | In the case of full points | Point proportion (%) |
| Lead-free brass material 3 | Test piece 9 | Δ | x | Δ | x | x | x | 60 | 1224 | 4.9 |
| | Test Piece 10 | ▲ | x | ○ | x | x | x | | | |
| | Test piece 11 | ▲ | ▲ | x | x | x | x | | | |
| | Test piece 12 | x | Δ | x | x | x | x | | | |
| Lead-free brass material 4 | Test piece 13 | Δ | x | x | | | | 56 | 1224 | 4.6 |
| | Test piece 14 | Δ | Δ | x | | | | | | |
| | Test piece 15 | ▲ | ▲ | ▲ | x | | | | | |
| | Test piece 16 | ▲ | Δ | Δ | x | | | | | |

As a result of the stress corrosion crack resistance test, the point proportions of test materials 9 to 12 are 4.9% and the point proportions of test materials 13 to 16 are 4.6%, not satisfying the criterion of the point proportion of 12.0%, thus, SCC resistance is not recognized to be excellent. When the content of Ni is increased from 0.18 mass % to 0.40 mass %, SCC resistance does not improve, that is, the effect of improving SCC resistance is not observed when Ni is used singly, and rather, lowering of SCC resistance by addition of Ni is confirmed.

Example 1-3 (Inventive Alloy (1) Containing Sn and Sb)

Subsequently, for confirming a stress corrosion crack property when Sb is added, rod-shaped materials obtained by adding Sb to the Sn: 1.5 mass % base material shown in the chemical component value in Table 9 were used as test materials, and subjected to the stress corrosion crack test. The results of the stress corrosion crack resistance test and the point proportions thereof are shown in Table 10. This test was conducted at a test time level of 4 hours, 8 hours, 16 hours, 24 hours and 48 hours.

TABLE 9

| Chemical component value of lead-free brass material (mass %) | | | | | | | | | | |
|---|---|---|---|---|---|---|---|---|---|---|
| Material | Cu | Zn | Pb | Fe | Sn | Ni | P | Se | Bi | Sb |
| Lead-free brass material 5 | 60.2 | 37.6 | 0.2 | 0.01 | 1.5 | 0.01 | 0.00 | 0.0 | 0.0 | 0.09 |

TABLE 10

| Result of stress corrosion crack resistance test of lead-free brass material | | | | | | | | | |
|---|---|---|---|---|---|---|---|---|---|
| Material | No. | 4 h | 8 h | 16 h | 24 h | 48 h | Total point | In the case of full points | Point proportion (%) |
| Lead-free brass material 5 | Test piece 17 | ○ | Δ | Δ | Δ | x | 340 | 900 | 37.8 |
| | Test piece 18 | Δ | ○ | Δ | x | x | | | |
| | Test piece 19 | Δ | Δ | x | Δ | Δ | | | |

As a result of the stress corrosion crack resistance test, the point proportions of test materials 17 to 18 are 37.8%, which is over the criterion of the point proportion of 12.0% in the case of the above-described lead-containing brass material. SCC resistance is improved and the effect of addition of Sb is recognized, as compared with test materials 1 to 4 and test materials 5 to 8 as the Sn: 1.5 mass % base material. Thickness-penetrating cracks are not generated at a moment of 8 hours, which exhibits stable SCC resistance.

Example 1-4 (Inventive Alloy (2) Containing Sn, Sb and Ni)

For confirming a stress corrosion crack property when Ni and Sb are added, rod-shaped materials obtained by adding Ni and Sb simultaneously to the Sn: 1.5 mass % base material shown in the chemical component value in Table 11 were used as test materials, and subjected to the stress corrosion crack test. The results of the stress corrosion crack resistance test and the point proportions thereof are shown in Table 12. This test was conducted at a test time level of 8 hours, 16 hours, 24 hours and 48 hours.

TABLE 11

| Chemical component value of lead-free brass material (mass %) | | | | | | | | | | |
|---|---|---|---|---|---|---|---|---|---|---|
| Material | Cu | Zn | Pb | Fe | Sn | Ni | P | Se | Bi | Sb |
| Lead-free brass material 6 | 60.3 | 37.7 | 0.0 | 0.00 | 1.5 | 0.15 | 0.00 | 0.0 | 0.0 | 0.09 |

TABLE 12

| Result of stress corrosion crack resistance test of lead-free brass material | | | | | | | | |
|---|---|---|---|---|---|---|---|---|
| Material | No. | 8 h | 16 h | 24 h | 48 h | Total point | In the case of full points | Point proportion (%) |
| Lead-free brass material 6 | Test piece 20 | ○ | ○ | ○ | ○ | 480 | 576 | 83.3 |
| | Test piece 21 | ○ | ○ | ○ | ▲ | | | |

As a result of the stress corrosion crack test, the point proportions of test materials No. 20 and 21 are 83.3%, namely, SCC resistance is improved as compared with the case of addition of Sb singly. Therefore, SCC resistance is improved by simultaneous addition of Ni and Sb, as compared with single addition of Sb, which is believed to be caused by interaction thereof. There is no generation of thickness-penetrating cracks at a moment of 8 hours, denoting stable SCC resistance.

Example 1-5 (Inventive Alloy (3) Containing Sn, Sb, Ni and P)

For confirming a stress corrosion crack property when Ni, Sb and P are added, rod-shaped materials obtained by adding Ni, Sb and P simultaneously to the Sn: 1.5 mass % base material shown in the chemical component value in Table 13 were used as test materials, and subjected to the stress corrosion crack test. The results of the stress corrosion crack resistance test and the point proportions thereof are shown in Table 14. This test was conducted at a test time level of 4 hours, 8 hours, 16 hours, 24 hours and 48 hours.

TABLE 13

| Chemical component value of lead-free brass material (mass %) | | | | | | | | | | |
|---|---|---|---|---|---|---|---|---|---|---|
| Material | Cu | Zn | Pb | Fe | Sn | Ni | P | Se | Bi | Sb |
| Lead-free brass material 7 | 61.2 | 35.7 | 0.0 | 0.00 | 1.5 | 0.17 | 0.07 | 0.0 | 0.0 | 0.09 |
| Lead-free brass material 8 | 60.6 | 36.3 | 0.2 | 0.01 | 1.5 | 0.19 | 0.08 | 0.0 | 0.0 | 0.09 |
| Lead-free brass material 9 | 60.0 | 35.9 | 0.2 | 0.01 | 1.5 | 0.19 | 0.10 | 0.0 | 0.0 | 0.09 |
| Lead-free brass material 10 | 61.1 | 36.7 | 0.2 | 0.01 | 1.5 | 0.17 | 0.08 | 0.0 | 0.0 | 0.10 |

TABLE 14

Result of stress corrosion crack resistance test of lead-free brass material

| Material | No. | 4 h | 8 h | 16 h | 24 h | 48 h | Total point | In the case of full points | Point proportion (%) |
|---|---|---|---|---|---|---|---|---|---|
| Lead-free brass material 7 | Test piece 22 | Δ | Δ | Δ | Δ | Δ | 756 | 1200 | 63.0 |
| | Test piece 23 | ○ | ○ | Δ | Δ | Δ | | | |
| | Test piece 24 | Δ | Δ | Δ | Δ | ▲ | | | |
| | Test piece 25 | Δ | ▲ | Δ | Δ | Δ | | | |
| Lead-free brass material 8 | Test piece 26 | Δ | ○ | ○ | ○ | ○ | 988 | 1200 | 82.3 |
| | Test piece 27 | ○ | Δ | ○ | ○ | ○ | | | |
| | Test piece 28 | ○ | ○ | Δ | Δ | Δ | | | |
| | Test piece 29 | ○ | ▲ | ○ | ▲ | ○ | | | |
| Lead-free brass material 9 | Test piece 30 | ○ | Δ | ○ | ○ | ○ | 1064 | 1200 | 88.7 |
| | Test piece 31 | ○ | Δ | ○ | Δ | ○ | | | |
| | Test piece 32 | ○ | ○ | ○ | Δ | Δ | | | |
| | Test piece 33 | ○ | ○ | ○ | Δ | ○ | | | |
| Lead-free brass material 10 | Test piece 34 | Δ | ○ | Δ | Δ | Δ | 828 | 1200 | 69.0 |
| | Test piece 35 | ○ | Δ | ○ | Δ | Δ | | | |
| | Test piece 36 | Δ | Δ | Δ | Δ | Δ | | | |
| | Test piece 37 | Δ | Δ | Δ | Δ | Δ | | | |

As a result of the stress corrosion crack test, the point proportions are 63.0 to 88.7% for any test materials, which are by far over the criterion of the SCC test of 12% in the case of a lead-containing brass material, thus, exhibiting excellent SCC resistance of the test materials. As described above, the point proportions are 83.3% when Ni and Sb are added simultaneously (in the case of test materials 20 and 21), and addition of only Ni and Sb is sufficient when only SCC resistance is taken into consideration, however, when a dezincification corrosion resistance is required additionally, further addition of P will be effective.

Example 1-6 (Inventive Alloy (4) Containing Sn, Sb, Ni and P)

Chemical component values of test materials composed of rod-shaped materials obtained by adding Ni, Sb and P simultaneously to the Sn: 1.2 mass % base material are shown in Table 15, and the results of the stress corrosion crack resistance test and the point proportions thereof are shown in Table 16. This test was conducted at a test time level of 4 hours, 8 hours, 12 hours, 16 hours and 24 hours. The point proportions are 34.4 to 63.5%, which are all over the criterion of the SCC test of 12%, and there is no occurrence of thickness-penetrating cracks at a time point of 8 hours. For obtaining excellent stress corrosion crack resistance, a larger amount of Sn is preferable, however, it was confirmed that, even if the amount of Sn is 1.2 mass % as in this test, excellent SCC resistance is exhibited as compared with a lead-containing brass material when the amount of Cu is in the range of 60.8 to 62.0 mass %.

TABLE 15

Chemical component value of lead-free brass material (mass %)

| Material | Cu | Zn | Pb | Fe | Sn | Ni | P | Se | Bi | Sb |
|---|---|---|---|---|---|---|---|---|---|---|
| Lead-free brass material 11 | 61.9 | 36.5 | 0.0 | 0.00 | 1.1 | 0.17 | 0.08 | 0.0 | 0.0 | 0.09 |
| Lead-free brass material 12 | 61.0 | 37.1 | 0.2 | 0.01 | 1.2 | 0.20 | 0.08 | 0.0 | 0.0 | 0.09 |
| Lead-free brass material 13 | 60.8 | 37.4 | 0.2 | 0.00 | 1.1 | 0.20 | 0.07 | 0.0 | 0.0 | 0.08 |

TABLE 16

Result of stress corrosion crack resistance test of lead-free brass material

| Material | No. | 4 h | 8 h | 16 h | 24 h | 48 h | Total point | In the case of full points | Point proportion (%) |
|---|---|---|---|---|---|---|---|---|---|
| Lead-free brass material 11 | Test piece 38 | Δ | Δ | Δ | Δ | Δ | 244 | 384 | 63.5 |
| | Test piece 39 | Δ | Δ | ▲ | Δ | Δ | | | |
| Lead-free brass material 12 | Test piece 40 | Δ | Δ | Δ | x | Δ | 200 | 384 | 52.1 |
| | Test piece 41 | Δ | Δ | x | Δ | Δ | | | |
| Lead-free brass material 13 | Test piece 42 | Δ | Δ | Δ | x | Δ | 132 | 384 | 34.4 |
| | Test piece 43 | Δ | Δ | ▲ | x | x | | | |

Example 1-7 (Inventive Alloy (5) Containing Sn, Sb, Ni and P)

Chemical component values of test materials composed of rod-shaped materials obtained by adding Sb and P simultaneously to the Sn: 1.2 mass % base material and adjusting the content of Ni to 0.4 mass % are shown in Table 17, and the results of the stress corrosion crack resistance test and the point proportions thereof are shown in Table 18. This test was conducted at a test time level of 4 hours, 6 hours, 8 hours, 16 hours and 24 hours. It was confirmed that the point proportions are 60.2% which is over the criterion of the SCC test of 12%, there is no generation of thickness-penetrating cracks at a moment of 8 hours, and excellent SCC resistance is exhibited even if the content of Ni is 0.4 mass %.

TABLE 17

| Chemical component value of lead-free brass material (mass %) | | | | | | | | | | |
|---|---|---|---|---|---|---|---|---|---|---|
| Material | Cu | Zn | Pb | Fe | Sn | Ni | P | Se | Bi | Sb |
| Lead-free brass material 14 | 61.8 | 36.2 | 0.2 | 0.00 | 1.2 | 0.39 | 0.07 | 0.0 | 0.0 | 0.09 |

TABLE 18

| Result of stress corrosion crack resistance test of lead-free brass material | | | | | | | | | |
|---|---|---|---|---|---|---|---|---|---|
| Material | No. | 4 h | 8 h | 16 h | 24 h | 48 h | Total point | In the case of full points | Point proportion |
| Lead-free brass material 14 | Test piece 44 | Δ | Δ | Δ | Δ | x | 314 | 522 | 60.2 |
| | Test piece 45 | Δ | Δ | Δ | Δ | x | | | |
| | Test piece 46 | Δ | ▲ | Δ | Δ | Δ | | | |

Figure 9:
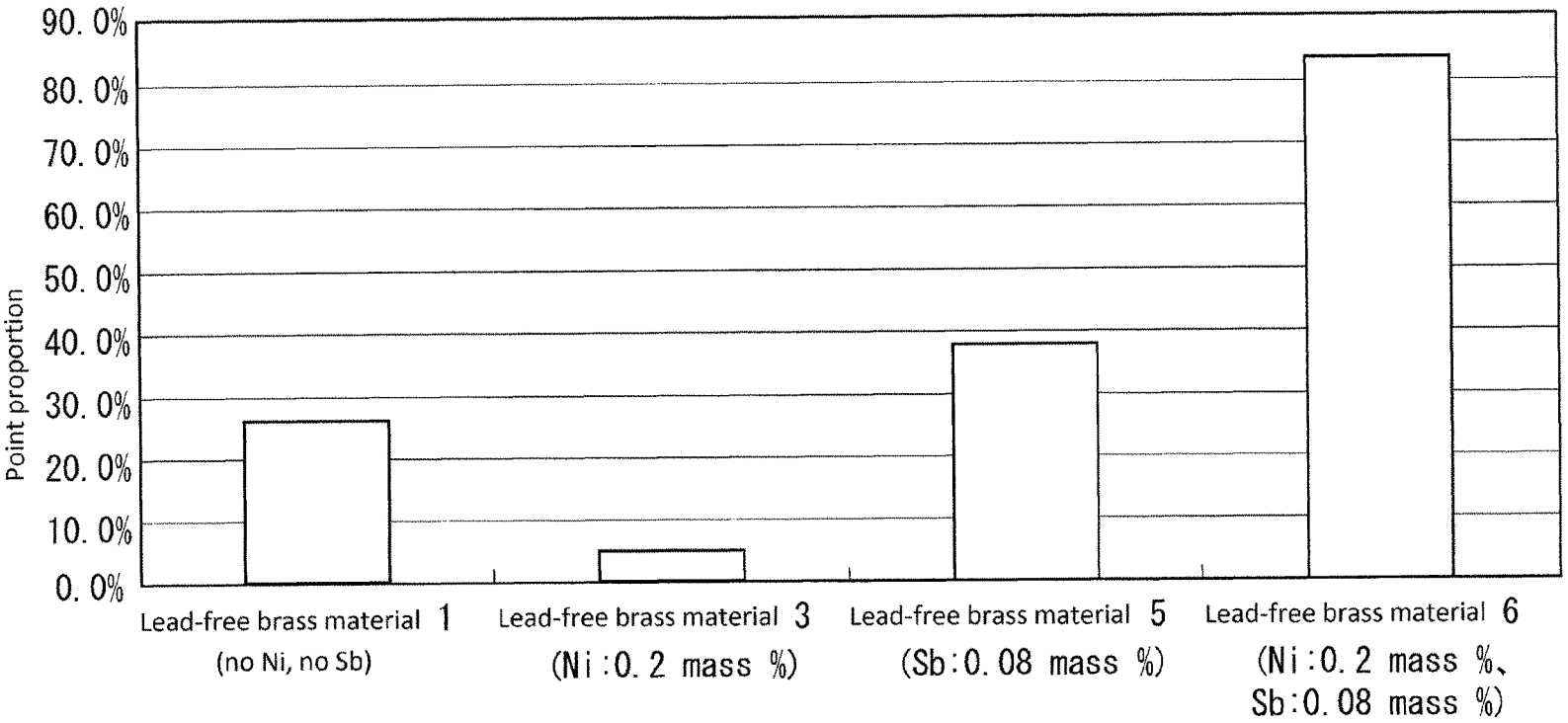
FIG. 9 is a graph showing the proportions of threaded SCC test points of the brass material of the present invention and other brass materials.
Figure 10:
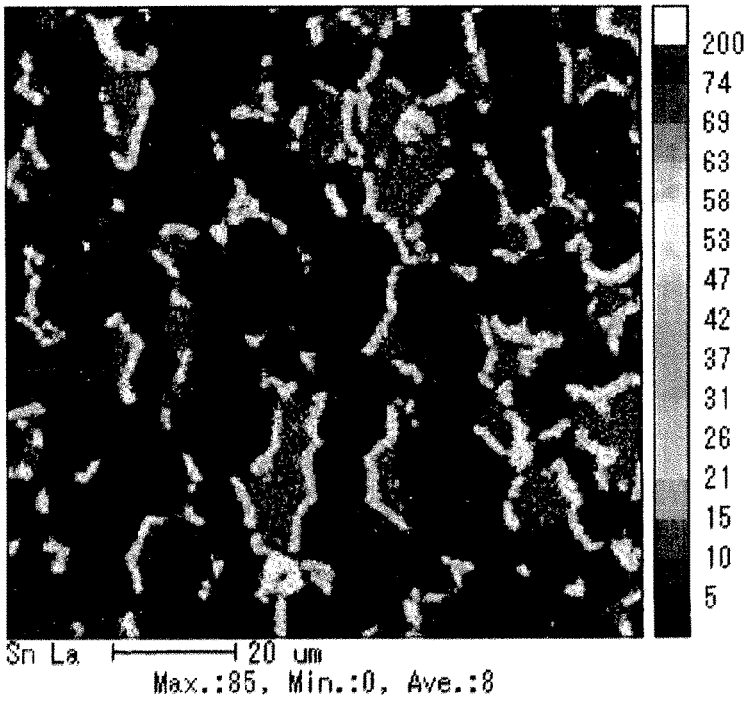
FIG. 10 is a magnified photograph showing the EPMA mapping image of Sn in a lead-free brass material 1.
Figure 11:
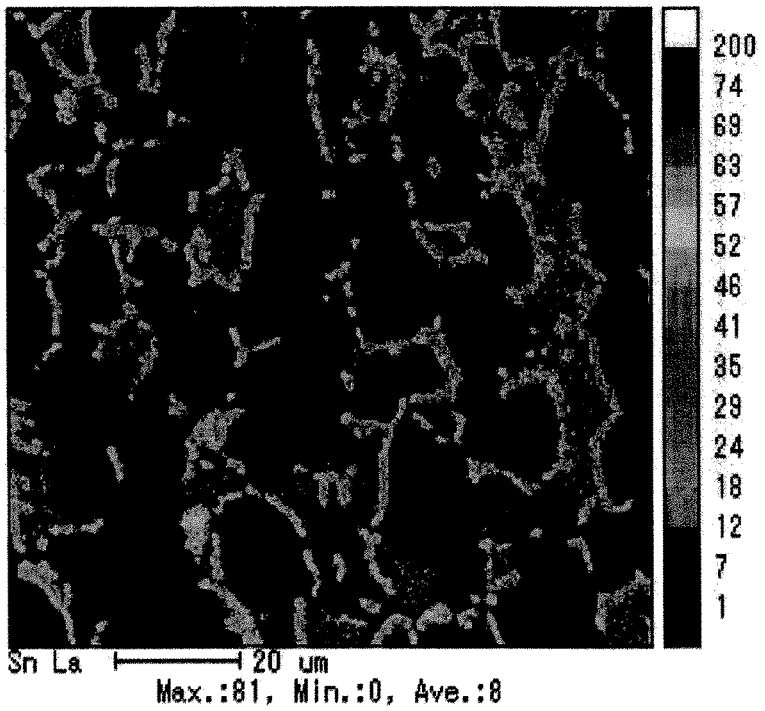
FIG. 11 is a magnified photograph showing the EPMA mapping image of Sn in a lead-free brass material 3.
Figure 12:
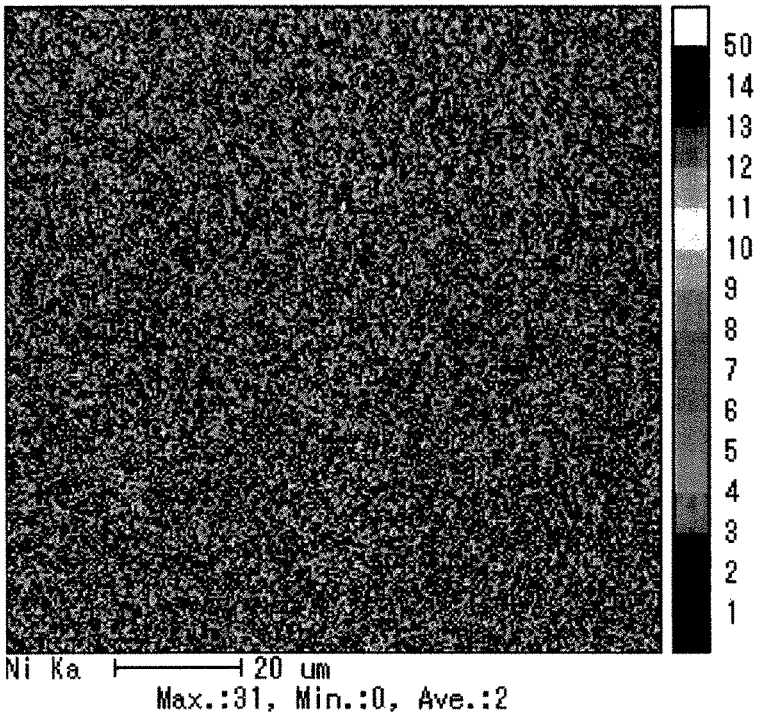
FIG. 12 is a magnified photograph showing the EPMA mapping image of Ni in a lead-free brass material 3.
Figure 13:
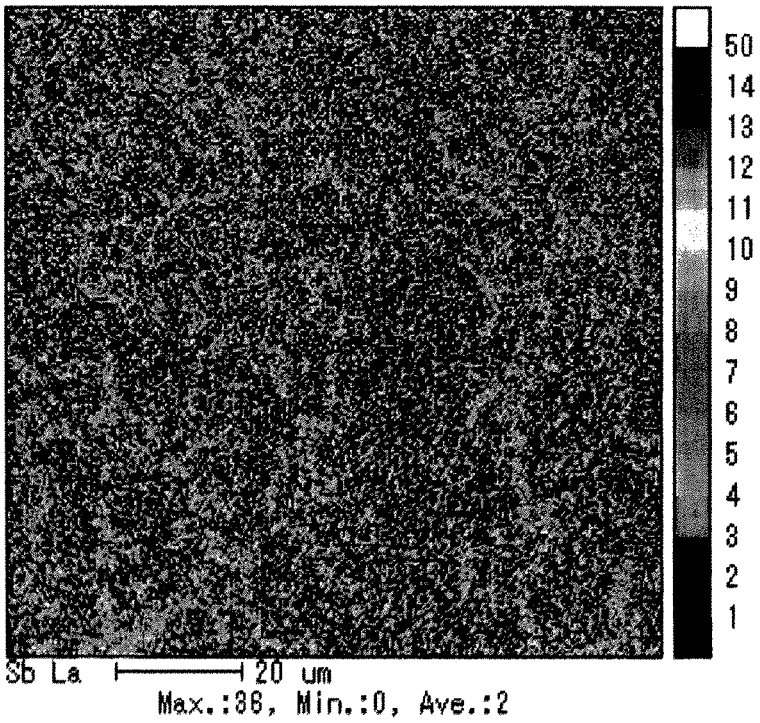
FIG. 13 is a magnified photograph showing the EPMA mapping image of Sb in a lead-free brass material 5.
Figure 14:
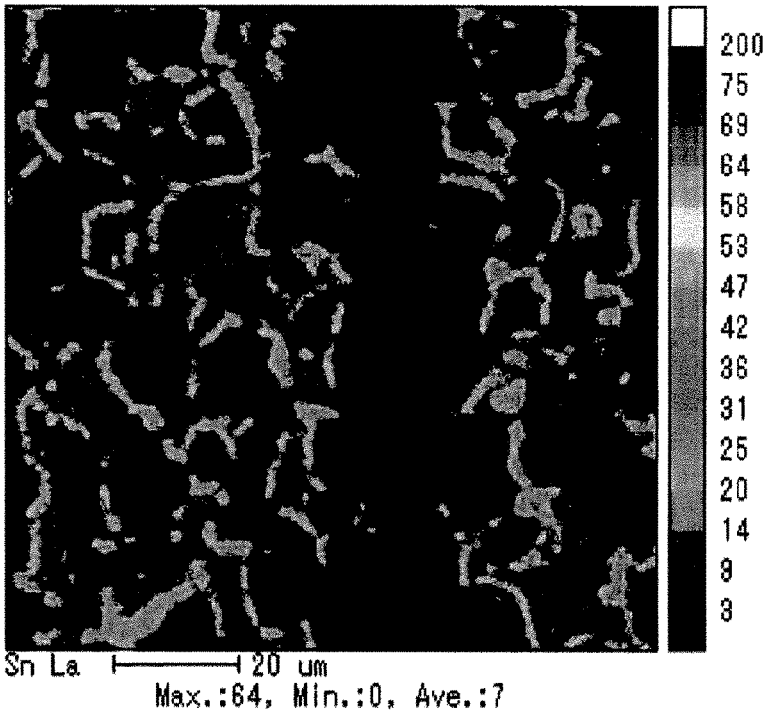
FIG. 14 is a magnified photograph showing the EPMA mapping image of Sn in a lead-free brass material 5.
Figure 15:
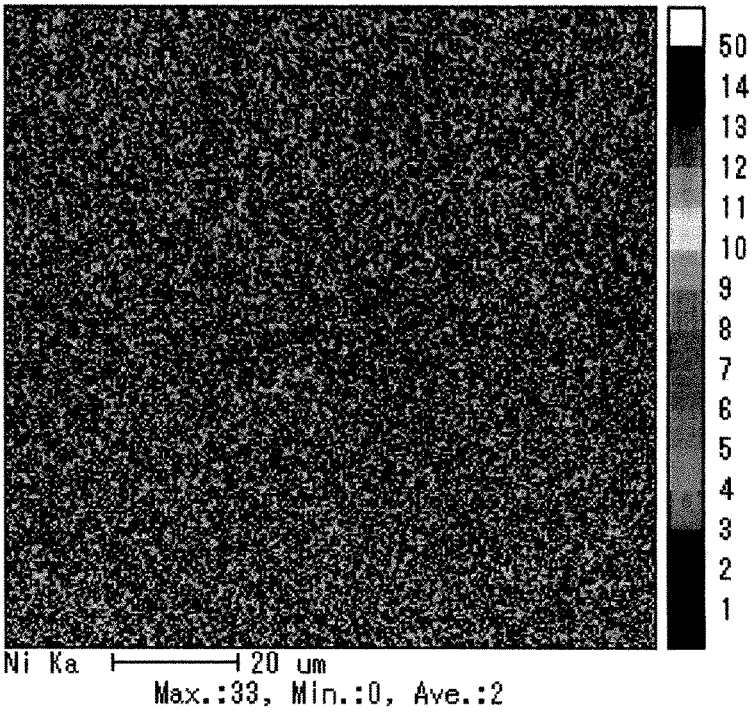
FIG. 15 is a magnified photograph showing the EPMA mapping image of Ni in a lead-free brass material 6.
Figure 16:
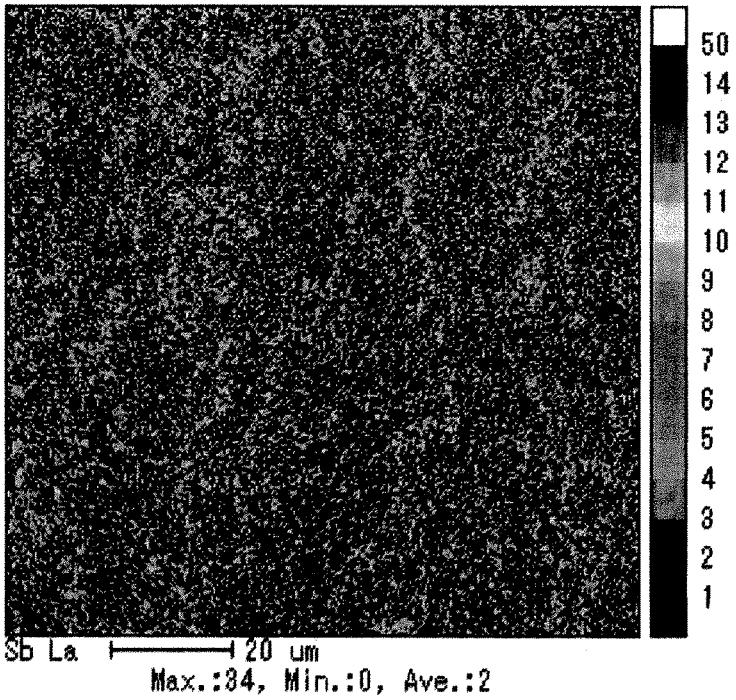
FIG. 16 is a magnified photograph showing the EPMA mapping image of Sb in a lead-free brass material 6.
Figure 17:
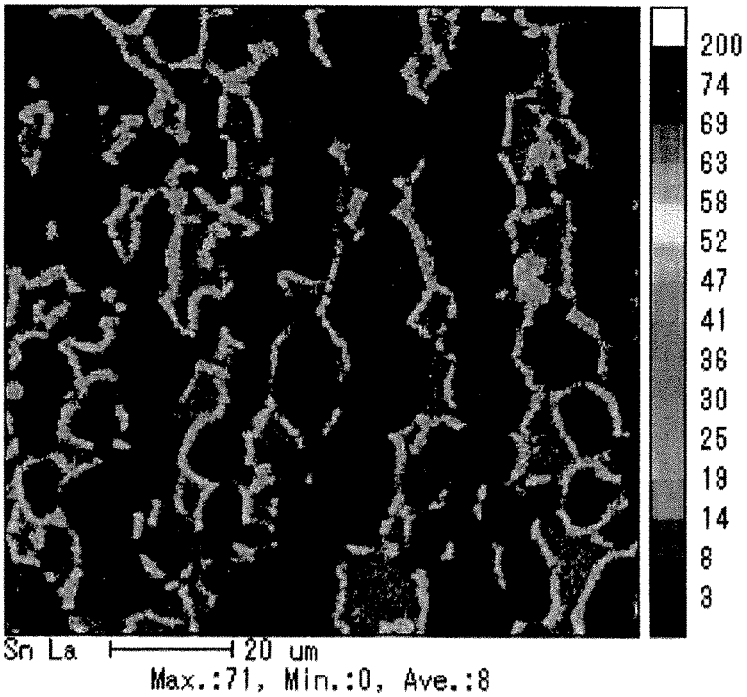
FIG. 17 is a magnified photograph showing the EPMA mapping image of Sn in a lead-free brass material 6.

As a result of the threaded SCC test conducted as described above, the test results and the point proportions as shown in FIG. 9 were obtained. For the lead-free brass material 1, the point proportion was 25.5% under no addition of Ni and Sb, for the lead-free brass material 3, the point proportion was 4.9% under addition of Ni: 0.2 mass %, for the lead-free brass material 5, the point proportion was 37.8% under addition of Sb: 0.08 mass %, and for the lead-free brass material 6, the point proportion was 83.3% under addition of Ni: 0.2 mass % and Sb: 0.08 mass %.

Namely, single addition of Ni does not contribute to improvement in SCC resistance, rather, lowers SCC resistance. When Sb is added singly, SCC resistance improves slightly, however, thickness-penetrating cracks occur even at a moment of 16 hours, and stable and excellent SCC resistance is not necessarily obtained. In contrast, when Ni and Sb are added simultaneously, SCC resistance improves remarkably. That is, it was confirmed that SCC resistance is improved not by single addition of each element selected from Ni and Sb but by interaction of Ni and Sb when these are added simultaneously, in the brass alloy of the present invention.

Here, the action by simultaneous addition of Ni and Sb was confirmed by (1) the number of generation of cracks, (2) the area ratio of β-phase, (3) mapping analysis and (4) quantitative analysis.

The test of measuring the number of generation of cracks and the analysis results are shown.

Micro observation of samples after the SCC test was performed, to check whether there is a tendency of generation of cracks depending on the material. The observation results are shown below. As a result of the observation, there were tendencies that the microstructure is composed of α-phase, β-phase and γ-phase in any material, that cracks are generated from α-phase and β-phase in any material, that the generated cracks pass through α-grain, β-grain and crystal grain boundary in any material and there is no difference between materials, and that a crack terminates in α-grain, grain boundary and γ-phase in any material and there is no difference between materials; and the like.

Since there is observed no structure in which a crack terminates in β-phase as described above, when a crack is generated from β-phase, the crack possibly progresses without terminating. Then, the number of cracks generated from β-phase was measured for each material. For measuring cracks generated from β-phase, the end face of a screw for a sample tube was cut and filled with a resin after the SCC test, and thereafter, polished and etched, and 100 photographs were taken for each material at a magnification of 1000, and the number of cracks generated from β-phase was measured. The results of measurement of the number of generation of cracks from β-phase are shown in Table 19. As a result of measurement, it was found that the number of cracks in the lead-free brass material 6 showing remarkably excellent SCC resistance was smallest among four materials.

TABLE 19

| Number of generation of crack from β-phase of each material | |
|---|---|
| Material | Number of generation of crack from β-phase |
| Lead-free brass material 1 (no Ni, no Sb) | 23 |
| Lead-free brass material 3 (Ni 0.2 mass %, no Sb) | 45 |
| Lead-free brass material 5 (no Ni, Sb 0.08 mass %) | 50 |
| Lead-free brass material 6 (Ni 0.2 mass %, Sb 0.08 mass %) | 12 |

Next, the results of measurement of the area ratio of β-phase are shown.

It was found that the number of cracks generated from β-phase varies depending on the material. Since the proportion of β-phase is supposed to be different depending on the composition, the area ratio of β-phase was measured for each material. In the measurement, 10 photographs of the microstructure of each material were taken at a magnification of 500 and the area ratio of β-phase was determined by point counting. The measurement results are shown in Table 20. The area ratio of β-phase decreased in the order of lead-free brass material 6>lead-free brass material 5>lead-free brass material 1>lead-free brass material 3, and the area ratio of β-phase of the lead-free brass material 6 exhibiting excellent SCC resistance showed a largest value of 16.5%.

Namely, it was clarified that the number of generated cracks is small in the lead-free brass material 6 though the amount of β-phase is largest in the lead-free brass material 6.

TABLE 20

Area ratio of β-phase of each material

| n | Lead-free brass material 1 | Lead-free brass material 3 | Lead-free brass material 5 | Lead-free brass material 6 |
|---|---|---|---|---|
| 1 | 9.8% | 14.4% | 17.7% | 14.1% |
| 2 | 13.2% | 11.1% | 21.8% | 16.4% |
| 3 | 13.8% | 15.4% | 16.7% | 18.2% |
| 4 | 14.8% | 11.1% | 13.7% | 17.9% |
| 5 | 14.9% | 12.2% | 13.4% | 15.0% |
| 6 | 15.1% | 14.4% | 10.9% | 17.3% |
| 7 | 14.1% | 13.6% | 14.2% | 14.7% |
| 8 | 14.2% | 12.8% | 16.2% | 15.2% |
| 9 | 13.0% | 14.1% | 13.6% | 17.4% |
| 10 | 16.3% | 15.6% | 15.1% | 18.8% |
| Average | 13.9% | 13.5% | 15.3% | 16.5% |

Subsequently, the results of mapping analysis are shown. FIGS. 10 to 17 show magnified photographs of EPMA mapping images of Sn, Ni and Sb in lead-free brass materials.

Mapping analysis of each element was carried out by an electron probe micro analyzer (EPMA). The analysis conditions included an accelerating voltage of 15 kV, a beam size of 1 μm, a beam current of 30 nA, a sample current of 20 nA, a sampling time of 20 (ms), and analysis field of 102.4 μm×102.4 μm (×3000).

In the mapping, the concentration of each element is represented by numerical values and light and dark colors described on the right side of the photograph, and smaller the numerical value, the lower the concentration. It was confirmed that the Cu concentration is high in α-phase, the Zn concentration is high in β-phase and the Sn concentration is high in γ-phase. The present location of Ni cannot be specified in any of the lead-free brass material 3 and the lead-free brass material 6. Sb tends to exist at the same location as that of Sn, and is supposed to exist in γ-phase.

As a result of mapping analysis, it was found that the concentration of Sn present in γ-phase varies slightly depending on the material. That is, in the lead-free brass material 1 (FIG. 10) and the lead-free brass material 3 (FIG. 11), Sn in γ-phase is partially shown brightly, teaching high concentration. In contrast, in the lead-free brass material 5 containing Sb added (FIG. 14) and the lead-free brass material 6 containing Ni and Sb added (FIG. 17), partial bright parts are not observed, teaching the low concentration of Sn in γ-phase.

In the mapping result of Sb in the lead-free brass material 5, Sb present in γ-phase is shown brighter than the circumference in some parts. This phenomenon teaches that Sb itself is possibly segregated in γ-phase, though single addition of Sb has a function of suppressing segregation of Sn in γ-phase. Therefore, this is believed as one cause for the case in which the lead-free brass material 5 does not necessarily exhibit stable and excellent SCC resistance.

In the lead-free brass material 6 in which Ni and Sb have been added simultaneously, locations of high Sn concentration and high Sb concentration are not observed in γ-phase, thus, Ni is believed to suppress segregation of Sn and Sb. Therefore, one reason for remarkable improvement in SCC resistance as compared with the lead-free brass material 5 is believed as a function of Ni of uniformly dispersing Sn and Sb in γ-phase.

The results of quantitative analysis are shown below.

Since it was found by mapping analysis that specific elements are present in respective phases, quantitative analysis was conducted. Quantitative analysis of each phase was carried out by a wavelength dispersive X-ray spectrometer (WDX). The analysis was carried out under conditions of an accelerating voltage of 15 kV and a beam current of 10 nA. In the case of the 60/40 brass, it is calculated that the X-ray generation region spreads toward depth direction and the beam spreads by about 1 μm when the accelerating voltage is 15 kV, in point analysis. Therefore, a relatively large-sized phase was selected and analyzed. The results of quantitative analysis of α-phase, β-phase and γ-phase are shown in Tables 21 to 23, respectively. Here, the analyzed value is not the content itself. The value of Ni is a reference value revealing its presence or absence.

TABLE 21

Result of quantitative analysis of α-phase of each material (mass %)

| Material | Cu | Zn | Sn | Ni | Sb |
|---|---|---|---|---|---|
| Lead-free brass material 1 | 64.8 | 33.9 | 1.3 | 0.0 | 0.0 |
| Lead-free brass material 3 | 63.8 | 34.6 | 0.7 | 0.9 | 0.0 |
| Lead-free brass material 5 | 64.3 | 34.4 | 0.8 | 0.0 | 0.5 |
| Lead-free brass material 6 | 61.8 | 36.1 | 0.8 | 0.6 | 0.6 |

TABLE 22

Result of quantitative analysis of β-phase of each material (mass %)

| Material | Cu | Zn | Sn | Ni | Sb |
|---|---|---|---|---|---|
| Lead-free brass material 1 | 57.9 | 40.4 | 1.7 | 0.0 | 0.0 |
| Lead-free brass material 3 | 57.0 | 39.6 | 2.2 | 1.2 | 0.0 |
| Lead-free brass material 5 | 56.7 | 40.4 | 2.4 | 0.0 | 0.5 |
| Lead-free brass material 6 | 57.7 | 39.0 | 1.5 | 1.4 | 0.4 |

TABLE 23

Result of quantitative analysis of γ-phase of each material (mass %)

| Material | Cu | Zn | Sn | Ni | Sb |
|---|---|---|---|---|---|
| Lead-free brass material 1 | 52.7 | 37.8 | 9.5 | 0.0 | 0.0 |
| Lead-free brass material 3 | 50.5 | 39.5 | 10.0 | 0.0 | 0.0 |
| Lead-free brass material 5 | 47.8 | 43.3 | 8.0 | 0.0 | 0.9 |
| Lead-free brass material 6 | 51.3 | 40.2 | 6.2 | 1.2 | 1.1 |

The results of respective tables indicate that the amount of Cu is in the range of 61 to 65 mass %, the amount of Zn is in the range of 33 to 36 mass % and the amount of Sn is in the range of 0.7 to 1.3 mass % for α-phase, and a remarkable difference depending on the material is not present. For β-phase, the amount of Cu is in the range of 56 to 58 mass %, the amount of Zn is in the range of 39 to 40 mass % and the amount of Sn is in the range of 1.5 to 2.4 mass %, that is, a remarkable difference depending on the material is not present like α-phase. For γ-phase, the concentration of Sn was about 9 mass % in the lead-free brass material 1 and the lead-free brass material 3 showing no excellent SCC resistance. In the lead-free brass material 5 having SCC resistance improved slightly by addition of Sb, the concentration of Sn in γ-phase lowered to about 8 mass %. In the lead-free brass material 6 having SCC resistance improved remarkably by simultaneous addition of Ni and Sb, the concentration of Sn in γ-phase lowered further to about 6 mass %. Therefore, it is understood that, when SCC resistance is more excellent in the material, the concentration of Sn in γ-phase is lower, and segregation of Sn is suppressed.

According to the above-described facts, adding Ni and Sb simultaneously to suppress segregation of Sn and Sb in γ-phase, to cause uniform dispersion and to suppress generation of cracks is believed as a reason for remarkably excellent SCC resistance of the lead-free brass material 6.

EXAMPLE 2

Subsequently, the dezincification corrosion resistance of the lead-free brass alloy of the present invention was verified by a test. This anti-dezincification test was conducted according to the brass dezincification corrosion test method prescribed in ISO6509-1981.

Example 2-1 (Cast Material)

One collected from cast materials produced by metal mold casting was used as a test material. The casting conditions thereof are shown in Table 24.

TABLE 24

| Casting condition | |
|---|---|
| Item | Condition |
| Melting furnace | 15 kg high frequency experimental furnace |
| Melting material | New material such as No. 1 copper wire, electrolytic zinc, tin metal and the like |
| Melting weight | 10 kg |
| Melting temperature | 1050° C. |
| Pouring temperature | 1000° C. |
| Template | φ40 × 80 L cast iron mold |

The results by the above-described anti-dezincification test are shown in Table 25. As the judging criteria of the test results, the maximum dezincification corrosion depth of 100 μm or less was evaluated as ◎, the depth of 100 to 200 μm or less was evaluated as ○, the depth of 200 to 400 μm or less was evaluated as Δ, and the depth larger than 400 μm was evaluated as x.

In Table 25, the maximum dezincification corrosion depth of the comparative material 5 containing Cu, Zn and Sn added was 437 μm, and evaluated as x. The comparative material 6 obtained by adding P to this comparative material 5 has a maximum dezincification corrosion depth of 154 μm and the test material 47 obtained by adding Sb to this comparative material 5 has a maximum dezincification corrosion depth of 118 μm, thus, judged to be ○. The test material 49 further containing Sb and P added has a maximum dezincification corrosion depth of 62 μm, thus, judged to be ◎. From the above-described results, it was confirmed that simultaneous addition of Sb and P is necessary when a strict dezincification corrosion resistance is required.

From the results of the comparative materials 7 and 8 and the test materials 48 and 50 containing about 0.2 mass % of Ni added, it was confirmed that the effect of addition of a trace amount of Ni on an anti-dezincification corrosion property is small.

Further, it was confirmed that inclusion of Bi has an effect on improvement of a dezincification corrosion resistance, since the test material 51 obtained by adding a trace amount of Bi to the test material 48 (the maximum dezincification corrosion depth: 194 μm) has a maximum dezincification corrosion depth of 92 μm.

Example 2-2 (Rod-Shaped Material)

Next, a dezincification corrosion resistance when the test material was composed of an extruded rod (φ35 extruded material) as a lead-free brass alloy was confirmed by a test. The results of the anti-dezincification test are shown in Table 26.

TABLE 25

Result of anti-dezincification corrosion test of casting material

| | Chemical component value (mass %) | | | | | | | | | Maximum dezincification corrosion depth | |
|---|---|---|---|---|---|---|---|---|---|---|---|
| No. | Cu | Sn | Sb | Ni | P | Pb | M | Fe | Zn | (μm) | Judgment |
| Test piece 47 | 62.6 | 1.6 | 0.10 | 0.00 | 0.00 | 0.0 | 0.0 | 0.00 | Remainder | 118 | ○ |
| Test piece 48 | 62.6 | 1.5 | 0.10 | 0.20 | 0.00 | 0.0 | 0.0 | 0.00 | Remainder | 194 | ○ |
| Test piece 49 | 62.9 | 1.4 | 0.10 | 0.00 | 0.10 | 0.0 | 0.0 | 0.00 | Remainder | 62 | ◎ |
| Test piece 50 | 62.6 | 1.5 | 0.10 | 0.19 | 0.10 | 0.0 | 0.0 | 0.00 | Remainder | 48 | ◎ |
| Test piece 51 | 62.2 | 1.5 | 0.10 | 0.20 | 0.00 | 0.0 | 0.3 | 0.00 | Remainder | 92 | ◎ |
| Comparative material 5 | 62.8 | 1.6 | 0.00 | 0.00 | 0.00 | 0.0 | 0.0 | 0.00 | Remainder | 437 | x |
| Comparative material 6 | 63.0 | 1.6 | 0.00 | 0.00 | 0.11 | 0.0 | 0.0 | 0.00 | Remainder | 154 | ○ |
| Comparative material 7 | 62.6 | 1.7 | 0.00 | 0.19 | 0.00 | 0.0 | 0.0 | 0.00 | Remainder | 443 | x |
| Comparative material 8 | 63.0 | 1.5 | 0.00 | 0.20 | 0.11 | 0.0 | 0.0 | 0.00 | Remainder | 165 | ○ |

TABLE 26

| Result of anti-dezincification test of extruded material | | | | | | | | | |
|---|---|---|---|---|---|---|---|---|---|
| Material | chemical component (targeted component value), mass % | | | | | | | Maximum dezincification | |
| name | Cu | Sn | Sb | Ni | P | Pb | Zn | corrosion depth (μm) | Judgment |
| Test piece 52 | 60.2 | 1.5 | 0.09 | 0.20 | 0.00 | 0.0 | Remainder | 445 | x |
| Test piece 53 | 61.5 | 1.5 | 0.09 | 0.20 | 0.09 | 0.0 | Remainder | 31 | ◎ |
| Test piece 54 | 61.5 | 1.2 | 0.09 | 0.20 | 0.09 | 0.0 | Remainder | 26 | ◎ |
| Test piece 55 | 60.2 | 1.5 | 0.09 | 0.20 | 0.09 | 0.2 | Remainder | 60 | ◎ |
| Test piece 56 | 60.7 | 1.5 | 0.09 | 0.20 | 0.09 | 0.2 | Remainder | 25 | ◎ |

According to the results in the table, the maximum dezincification corrosion depth of the test material 52 containing no P was 445 μm, and judged to be x. In contrast, the maximum dezincification corrosion depth was less than 100 μm in any of the test materials 53, 54, 55 and 56 containing P, and it was confirmed that a dezincification corrosion resistance is improved by addition of P on the premise of inclusion of Cu, Sn and Sb.

EXAMPLE 3

For confirming the effect of improving machinability by inclusion of Sb in the lead-free brass alloy of the present invention, a cutting test was conducted.

Here, a brass alloy which does not contain lead as a free-machining addition element is known to show a remarkably lowered cutting property as described above. The cutting property is roughly classified into 4 items: resistance value, tool life, chip crushing property and finished surface grade, and of them, "chip crushing property (treating property)" is most important in actual production since when it is poor, a defect of winding on a machine and no discharge of chips occurs in mechanical cutting processing.

Example 3-1 (Cutting Test)

For verifying the improvement in machinability (particularly, chip crushing property) by inclusion of Sb, a test material having the chemical component shown in Table 27 and a comparative material for comparison with this were cut in a cutting test, and the cutting results of them were confirmed.

TABLE 27

| Chemical component value (mass %) | | | | | | | | | |
|---|---|---|---|---|---|---|---|---|---|
| Material | Cu | Pb | Fe | Sn | Ni | Bi | P | Sb | Zn |
| Test piece 57 | 60.2 | 0.2 | 0.0 | 1.5 | 0.03 | 0.0 | 0.00 | 0.08 | 37.9 |
| Comparative material 9 | 60.3 | 0.2 | 0.0 | 1.5 | 0.00 | 0.0 | 0.00 | 0.00 | 37.0 |

In the cutting test, the material was cut on a horizontal NC turning machine, and the cutting resistance in this operation was measured. As an apparatus for measuring the cutting resistance, the kistler tool dynamometer triaxial type was used. The cutting property was evaluated by the weight per chip piece. The cutting test conditions in this operation are shown in Table 28.

TABLE 28

| Cutting test condition | |
|---|---|
| Item | Condition |
| Sample shape | φ31 × 150 mm periphery machined rod-shaped material (drawn material) |
| Cutting speed | 152.6 m/min (1800 rpm) |
| Cutting amount | Piece thickness 2 mm |
| Feed per revolution | 0.2 mm/rev |
| Byte-chip | TDSN2525MN12-SNMA120404HTI10 |

Principal forces, thrust forces and feed forces when a test material containing Sb and a comparative material containing no Sb are cut under the above-described cutting test conditions were measured respectively, and the cutting resistance total force was calculated from these principal forces, thrust forces and feed forces. The cutting resistance total force is calculated according to the following formula.

$$\text{Cutting resistance total force}=((\text{principal force})^2+(\text{thrust force})^2+(\text{feed force})^2)^{1/2}$$

The results of the principal forces, thrust forces and feed forces measured and the value of the calculated total force are shown in Table 29 entitled "result of cutting test".

TABLE 29

| Result of cutting test | | | | | | |
|---|---|---|---|---|---|---|
| | Sb | Cutting resistance (N) | | | | Weight |
| Material | content (mass %) | Thrust force | Feed force | Principal force | Total force | of 1 chip (g) |
| Test piece 57 | 0.08 | 270.5 | 197.7 | 544.9 | 638.3 | 0.086 |
| Comparative material 9 | 0.00 | 292.5 | 210.4 | 557.7 | 667.3 | 0.178 |

It was confirmed from Table 29 that the weight of a chip piece was 0.178 g for the comparative material 9 containing no Sb, while the weight of a chip piece was as small as 0.086 g for the test material 57 containing 0.09% of Sb, that is, by inclusion of a trace amount of Sb, the chips becomes finer and machinability is improved.

Example 3-2 (Observation of Microstructure)

Figure 2:
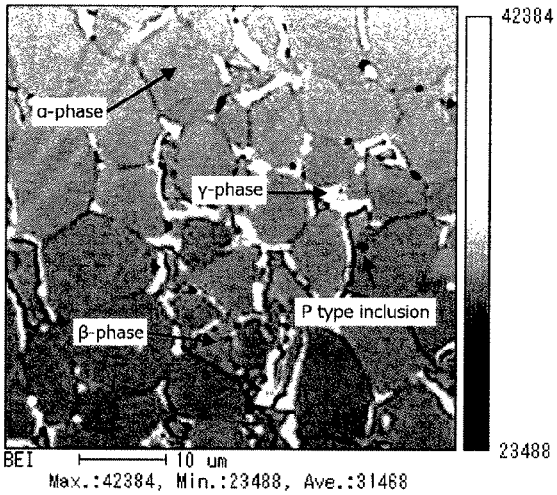
FIG. 2 is a magnified photograph of the microstructure of a test material of a brass alloy containing Sb.
Figure 3:
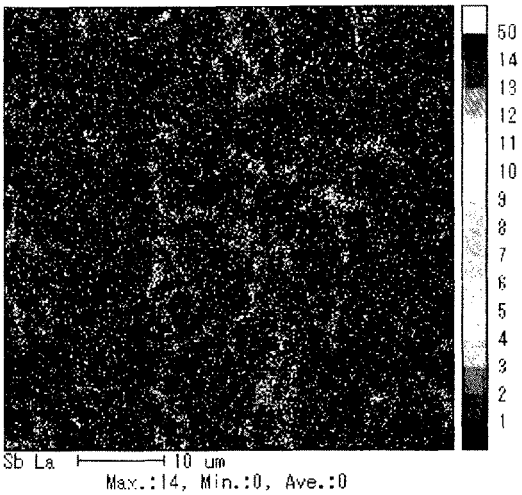
FIG. 3 is a magnified photograph showing the EPMA mapping image of Sb in FIG. 2.

Subsequently, the chemical component of the test material 58 close to that of the test material 57 is shown in Table 30, and further, the magnified photograph of the microstructure of this test material 49 is shown in FIG. 2, and the magnified photograph of the EPMA mapping image of Sb in FIG. 2 is shown in FIG. 3. The component structure of this test material 58 is similar to that of the test material 57, and the Sb behaviors of them are identical, therefore, the test material 58 is substituted for the test material 57.

TABLE 30

| Chemical component value (mass %) | | | | | | | | | |
|---|---|---|---|---|---|---|---|---|---|
| Material | Cu | Pb | Fe | Sn | Ni | Bi | P | Sb | Zn |
| Test piece 58 | 60.6 | 0.2 | 0.0 | 1.5 | 0.19 | 0.0 | 0.08 | 0.09 | 36.3 |

When 0.09 mass % of Sb is added, γ-phase is shown brightly as shown in the EPMA image of FIG. 3, teaching the high concentration of Sb. It is understood from this fact that Sb is solid-solved and present in γ-phase, not in an intermetallic compound.

Owing to reinforcement by solid solution, the γ-phase containing solid-solved Sb is hard and embrittled and acts as an origin where chips are crushed, thus, the chip crushing property is improved.

Example 3-3 (Comparative Alloy (1))

There is known a brass alloy which is an alloy containing Sb: 0.3 to 2.0 mass % and Mn: 0.2 to 1.0 mass % and at least two or more third elements (0.1 mass % to 1.0 mass %) selected from Ti, Ni, B, Fe, Se, Mg, Si, Sn, P and rare earth elements and in which a hard intermetallic compound containing Sb is generated in the crystal grain boundary, thereby improving machinability (Japanese Patent Application National Publication No. 2007-517981). In the test material 57, however, Mn is not contained, and additionally, the content of Sb is as low as 0.08 mass %, and Sb is not present in an intermetallic compound but solid-solved in γ-phase, therefore, its machinability improving mechanism is basically different.

Example 3-4 (Comparative Alloy (2))

Figure 4:
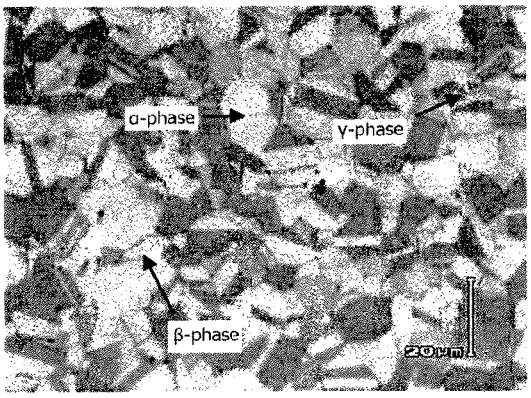
FIG. 4 is a magnified photograph of the microstructure of naval brass.

The chemical component value of naval brass is shown in Table 31 and the magnified photograph of the microstructure of this naval brass is shown in FIG. 4. In the case of naval brass, when the content of Sn is 1.0 mass % or less, γ-phase is scarcely generated and Sb cannot be solid-solved, therefore, the effect of improving machinability is not obtained.

TABLE 31

| Chemical component value (mass %) | | | | | | | | | |
|---|---|---|---|---|---|---|---|---|---|
| Material | Cu | Pb | Fe | Sn | Ni | Bi | P | Sb | Zn |
| naval brass | 61.0 | 0.1 | 0.0 | 0.8 | 0.00 | 0.0 | 0.00 | 0.00 | 38.1 |

Example 3-5 (Comparative Alloy (3))

For verifying the effect exerted on machinability by Sb in a Bi-containing brass alloy, a cutting test was conducted. The chemical components of the Bi-containing brass alloys used in the cutting test are shown in Table 32. Bi is contained at a content of 1.0 mass % or more in any of the comparative materials, one of which containing no Sb and the other containing 0.08 mass % of Sb. The results of the cutting test are shown in Table 33, and the dispersion analysis table of one chip piece is shown in Table 34.

TABLE 32

| Chemical component value (mass %) | | | | | | | | | | |
|---|---|---|---|---|---|---|---|---|---|---|
| Material | Cu | Pb | Fe | Sn | Ni | Se | Bi | P | Sb | Zn |
| Bi-containing brass material 1 | 60.4 | 0.0 | 0.0 | 1.0 | 0.16 | 0.0 | 1.3 | 0.17 | 0.00 | 37.0 |
| Bi-containing brass material 2 | 60.2 | 0.0 | 0.0 | 1.0 | 0.15 | 0.0 | 1.4 | 0.17 | 0.08 | 37.0 |

TABLE 33

| Result of cutting test | | | | | |
|---|---|---|---|---|---|
| | Sb | Cutting | | Weight of one chip (g) | |
| Material | amount (mass %) | allowance (mm) | | Measured value | Average |
| Bi-containing brass material 1 | 0.00 | Chip thickness 3 | Comparative material 10 | 0.00231 | 0.00224 |
| | | | Comparative material 11 | 0.00218 | |
| Bi-containing brass material 2 | 0.08 | Chip thickness 3 | Comparative material 12 | 0.00203 | 0.00206 |
| | | | Comparative material 13 | 0.00210 | |

TABLE 34

| Analyzed value of dispersion of weight of one chip | | | | | |
|---|---|---|---|---|---|
| Factor | Square sum | Degree of freedom | Dispersion | Dispersion ratio | P value (upper side) |
| Presence or absence of antimony | 3.24E−08 | 1 | 3.24E−08 | 5.945 | 0.135 |
| Error e | 1.09E−08 | 2 | 5.45E−09 | | |
| Sum | 4.33E−08 | 3 | | | |

In the results of the cutting test, there is a tendency that a chip becomes somewhat finer when 0.08 mass % of Sb is contained, however, a statistically significant difference is not recognized since the P value is 0.135 in the dispersion analysis table, thus, it is concluded that the tendency is within dispersion generated by the experiment and Sb exerts no influence on machinability.

In the alloy containing 1 mass % or more of Bi as a free-machining additive, the effect of Bi of improving machinability is extremely larger as compared with Sb, as described above, thus, the effect of Sb of improving machinability cannot be recognized.

EXAMPLE 4

Next, the effect of improving machinability by allowing P to be contained in a lead-free copper alloy was confirmed.

Example 4-1 (Evaluation Intended for Valve Part)

Figure 5:
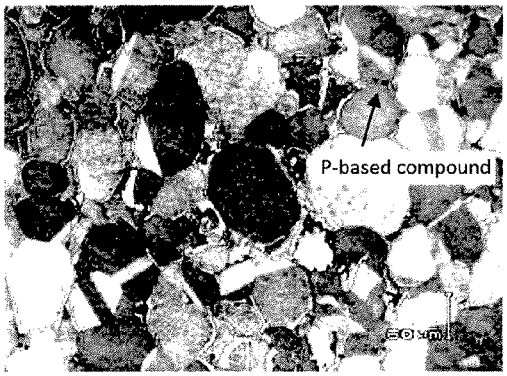
FIG. 5 is a magnified photograph of the microstructure of a test material of a brass alloy containing P.
Figure 6:
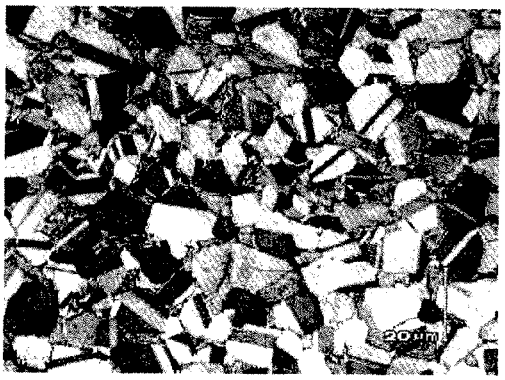
FIG. 6 is a magnified photograph of the microstructure of a brass alloy for comparison.

In this case, the housing of a ball valve is roughly processed, and in the present example, a product obtained by cutting-processing the inner circumference of the body of a two piece type threaded forged ball valve (nominal diameter: 1B) was used as an evaluation subject, and a brass alloy containing P was called a test material 59 and a brass alloy containing no P was called a test material 60 and chips generated in processing them were compared. The chemical components of the test material 59 and the test material 60 are shown in Table 35, and the photographs of the microstructure of the test material 59 and the test material 60 are shown in FIGS. 5 and 6, respectively.

TABLE 35

| Chemical component value (mass %) | | | | | | | | | |
|---|---|---|---|---|---|---|---|---|---|
| Material | Cu | Pb | Fe | Sn | Ni | Bi | P | Sb | Zn |
| Test piece 59 | 62.3 | 0.0 | 0.0 | 1.6 | 0.17 | 0.0 | 0.10 | 0.08 | 35.8 |
| Test piece 60 | 60.7 | 0.0 | 0.0 | 1.7 | 0.15 | 0.0 | 0.00 | 0.08 | 37.3 |

Figure 7:
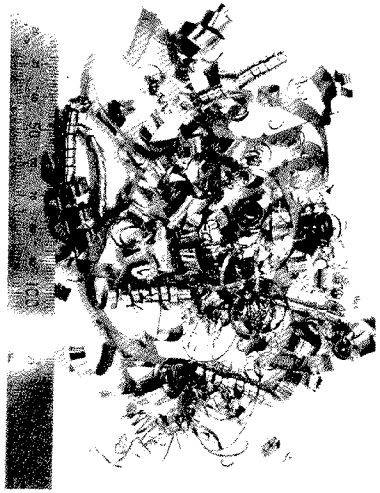
FIG. 7 is a photograph of the chip of a test material of a brass alloy containing P.
Figure 8:
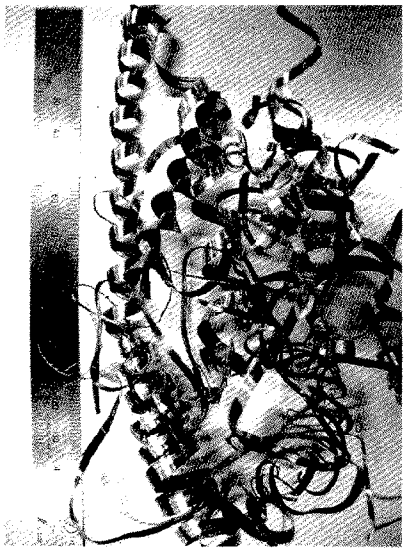
FIG. 8 is a photograph of the chip of a brass alloy for comparison.

Cutting of the test material is conducted by forming tool processing, and chips generated by this processing are shown in FIGS. 7 and 8. In the test material 60, chips continue as shown in FIG. 8, and there is a possibility of generation of troubles such as winding of the continuing chips on the chief axis or the like to stop rotation and the like. On the other hand, in the test material 59, chips are relatively separated as shown in FIG. 7, and in this case, the processing is possible without entangling chips on the chief axis or the like. The reason for this is that 0.10 mass % of P is contained and chips are separated by P and generated intermetallic compounds such as Cu, Ni and the like in the test material 59, in contrast to the test material 60.

As shown in FIG. 5, a hard and embrittled intermetallic compound is generated in the crystal grain boundary owing to inclusion of 0.10 mass % of P in the test material 59. Since the hard and embrittled P-based intermetallic compound acts as an origin where chips are separated in cutting-processing, the chip crushing property is improved. Principal forces, thrust forces and feed forces in cutting in this case were measured using rod-shaped materials (drawn material) like the above-described case containing Sb, and the cutting resistance total force was determined from them. The results of the cutting test in this case are shown in Table 36.

TABLE 36

| Result of cutting test | | | | | | |
|---|---|---|---|---|---|---|
| | | Cutting resistance (N) | | | | Weight |
| Material | P content (mass %) | Thrust force | Feed force | Principal force | Total force | of 1 chip (g) |
| Test piece 59 | 0.10 | 331.0 | 252.4 | 628.0 | 753.4 | 0.110 |
| Test piece 60 | 0.00 | 317.9 | 239.8 | 594.0 | 715.1 | 0.310 |

In the cutting test shown in Table 36, the weight of one chip piece is 0.310 g for the test material 60 containing no P added and 0.110 g for the Lest material 59 containing 0.10 mass % of P added, namely, the chip becomes finer to about ⅓, markedly representing the influence by the intermetallic compound.

Example 4-2 (Evaluation Intended for Rod-Shaped Material)

Subsequently, machinability by inclusion of P and Sb when the content of Sn is 1.2 mass % is verified. The chemical component values of the test materials composed of rod-shaped materials used in the cutting test are shown in Table 37, and the results of the cutting test are shown in Table 38. The conditions for the cutting test are as in Example 3. When the results are compared with the result of the comparative material 9 in Example 3, the weight per chip piece is smaller for the test materials 61 to 63 and the effect of improving machinability by P and Sb is confirmed, though the content of Sn in the test materials 61 to 63 is 1.1 to 1.2 mass % in contrast to the content of Sn of 1.5 mass % in the comparative material 9. Further, when the content of Ni is 0.2 mass % and 0.4 mass %, there is no significant difference, and the weight per chip piece is smaller as compared with the comparative material 9.

TABLE 37

| Chemical component value (mass %) | | | | | | | | | |
|---|---|---|---|---|---|---|---|---|---|
| Material | Cu | Zn | Pb | Fe | Sn | Ni | P | Hi | Sb |
| Test piece 61 | 61.9 | 36.1 | 0.2 | 0.00 | 1.1 | 0.39 | 0.08 | 0.00 | 0.08 |
| Test piece 62 | 61.0 | 37.1 | 0.2 | 0.01 | 1.2 | 0.20 | 0.08 | 0.00 | 0.09 |
| Test piece 63 | 60.8 | 37.4 | 0.2 | 0.01 | 1.1 | 0.20 | 0.07 | 0.00 | 0.08 |

TABLE 38

| Result of cutting test | | | | | |
|---|---|---|---|---|---|
| | Cutting resistance (N) | | | | |
| Material | Thrust force | Feed force | Principal force | Total force | Weight of 1 chip (g) |
| Test piece 61 | 287.7 | 214.1 | 577.1 | 678.5 | 0.042 |
| Test piece 62 | 287.6 | 212.9 | 579.2 | 680.8 | 0.037 |
| Test piece 63 | 288.7 | 215.7 | 576.0 | 679.4 | 0.039 |

EXAMPLE 5

Figure 18:
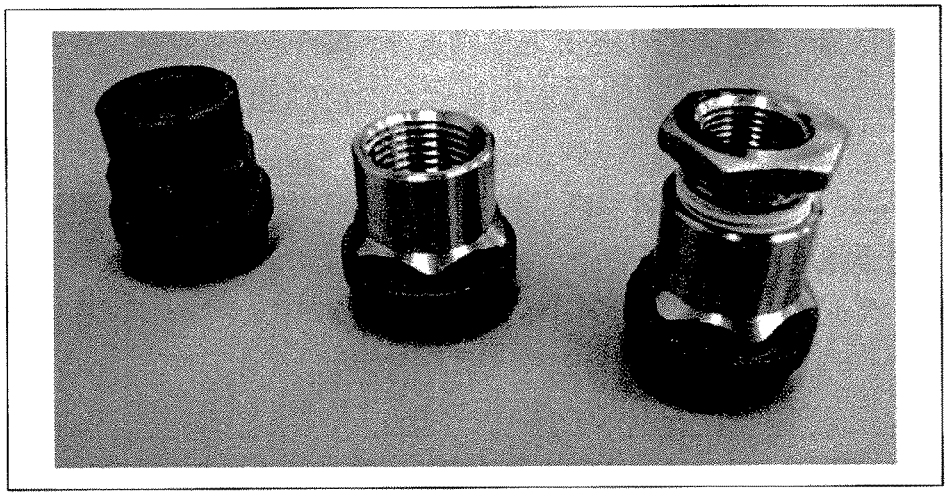
FIG. 18 is a photograph showing a forged article threaded SCC test sample.

For evaluating the stress corrosion crack resistance of the forged article of the lead-free brass alloy of the present invention, the following test was conducted. A forged sample shown on the left side in FIG. 18 was forged at a forging temperature of 760° C. and processed by an NC processing machine into φ25×34 (Rc ½ threaded coupling) shown in FIG. 18, which was used as a test piece for the test material and the comparative material. The threading torque of a stainless bushing is controlled to 9.8 N·m (100 kgf·cm), the ammonia concentration is controlled to 14%, and the temperature of a test room is controlled to 20° C. In this case, the point evaluation method is the same as in Example 1.

Example 5-1 (Comparative Alloy: Confirmation of Criterion Value)

For evaluating the stress corrosion crack resistance of a lead-containing brass forged material, a lead-containing brass forged material was used as a comparative material, and this comparative material was used as the criterion of a forged material. The time level of the stress corrosion crack test includes 4 hours, 8 hours, 16 hours and 24 hours. The chemical component values of a lead-containing brass forged material are shown in Table 39, the results of the stress corrosion crack resistance test are shown in Table 40 and the point evaluation results are shown in Table 41. In this case, the number of comparative materials was four: comparative material 14 to comparative material 17.

TABLE 39

| Chemical component value of lead-containing brass forged material (mass %) | | | | | | | | | | |
|---|---|---|---|---|---|---|---|---|---|---|
| Material | Cu | Zn | Pb | Fe | Sn | Ni | P | Se | Bi | Sb |
| Lead-containing brass forged material | 59.6 | 37.6 | 2.3 | 0.13 | 0.2 | 0.05 | 0.01 | 0.0 | 0.0 | 0.01 |

TABLE 40

| Result of stress corrosion crack resistance test of lead-containing brass forged material | | | | | |
|---|---|---|---|---|---|
| Material | No. | 4 h | 8 h | 16 h | 24 h |
| Lead-containing brass forged material | Comparative material 14 | ▲ | x | x | x |
| | Comparative material 15 | Δ | x | x | x |
| | Comparative material 16 | Δ | x | x | x |
| | Comparative material 17 | ▲ | x | x | x |

TABLE 41

| Result of point calculation ofstress corrosion crack resistance test of lead-containing brass forged material | | | | | | | | |
|---|---|---|---|---|---|---|---|---|
| Material | No. | 4 h | 8 h | 16 h | 24 h | Total point | In the case of full points | Point proportion |
| Lead-containing brass material | Comparative material 14 | 4 | 0 | 0 | 0 | 24 | 624 | 3.8% |
| | Comparative material 15 | 8 | 0 | 0 | 0 | | | |
| | Comparative material 16 | 8 | 0 | 0 | 0 | | | |
| | Comparative material 17 | 4 | 0 | 0 | 0 | | | |

According to the results of the stress corrosion crack resistance test of lead-containing brass forged materials (comparative materials 14 to 17), the total point is 24, and the point proportion can be calculated to 3.8% based on the full point of 624, which is used as a criterion. That is, when the point proportion is 3.8% or more in conducting the stress corrosion crack resistance test of the lead-free brass forged article of the present invention, the stress corrosion crack resistance is generally judged to be excellent.

As a result of the stress corrosion crack resistance test of the lead-containing brass forged material, thickness-penetrating cracks are generated for the first time at a passage of time of 8 hours, and not generated at a moment of 4 hours. Therefore, no generation of thickness-penetrating cracks at a moment of 4 hours in conducting the stress corrosion crack resistance test is also mentioned as one criterion, and this can be judged to give stable SCC resistance.

According to these facts, the brass forged alloy excellent in stress corrosion crack resistance provides (1) a point proportion of 3.8% or more when the results of the stress corrosion crack resistance test are judged based on the above-described judgment, and (2) no generation of thickness-penetrating cracks at a passage of time of 4 hours in conducting the stress corrosion crack resistance test.

Example 5-2 (Inventive Alloy)

Subsequently, the stress corrosion crack resistance test of a test material composed of the lead-free brass forged alloy of the present invention was carried out. The test method and the results of the test are shown below.

A forging sample having chemical component values shown in Table 42 was forged at 760° C., and processed by an NC processing machine into an Rc ½ threaded coupling, and the stress corrosion crack resistance test was performed. The results of the stress corrosion crack resistance test are shown in Table 43, and the point evaluation results are shown in Table 44. In this case, the number of test materials was four: test material 64 to test material 67.

TABLE 42

| Chemical component value of lead-free brass forged material (mass %) | | | | | | | | | | |
|---|---|---|---|---|---|---|---|---|---|---|
| Material | Cu | Zn | Pb | Fe | Sn | Ni | P | Se | Bi | Sb |
| Lead-free brass forged material | 60.8 | 37.0 | 0.2 | 0.02 | 1.5 | 0.21 | 0.09 | 0.0 | 0.0 | 0.09 |

TABLE 43

| Result of stress corrosion crack resistance test of lead-containing brass forged material | | | | | |
|---|---|---|---|---|---|
| Material | No. | 4 h | 8 h | 16 h | 24 h |
| Lead-containing brass forged material | Test piece 64 | Δ | ▲ | ▲ | Δ |
| | Test piece 65 | Δ | Δ | Δ | Δ |
| | Test piece 66 | Δ | Δ | ▲ | Δ |
| | Test piece 67 | Δ | Δ | Δ | Δ |

TABLE 44

| Result of point calculation of stress corrosion crack resistance test of lead-free brass forged material | | | | | | | | |
|---|---|---|---|---|---|---|---|---|
| Material | No. | 4 h | 8 h | 16 h | 24 h | Total point | In the case of full points | Point proportion |
| Lead-free brass material | Test piece 64 | 8 | 8 | 16 | 48 | 376 | 624 | 60.3% |
| | Test piece 65 | 8 | 16 | 32 | 48 | | | |
| | Test piece 66 | 8 | 16 | 16 | 48 | | | |
| | Test piece 67 | 8 | 16 | 32 | 48 | | | |

As a result of the above-described stress corrosion crack resistance test, the point proportion of the test materials 64 to 67 is 60.3%, by far exceeding 3.8% which is the above-described criterion of the point proportion. Thickness-penetrating cracks are not generated even at a moment after the test time of 24 hours, thus, excellent SCC resistance is confirmed.

EXAMPLE 6

The hot workability of the lead-free brass alloy of the present invention was confirmed by a forged article hot ductility test.

Chemical component values of test materials and comparative materials used in the test are shown in Table 45. Three test materials 68 to 70 were used, and a lead-containing brass material C3771 was used as the comparative material 18. The materials used were in the form of a φ35 mm extruded rod-shaped material.

TABLE 45

| Chemical component value of test material and comparative material (mass %) | | | | | | | | | | |
|---|---|---|---|---|---|---|---|---|---|---|
| Material | Cu | Zn | Pb | Fe | Sn | Ni | P | Se | Bi | Sb |
| Test piece 68 | 60.2 | 37.6 | 0.2 | 0.01 | 1.5 | 0.01 | 0.00 | 0.0 | 0.0 | 0.09 |
| Test piece 69 | 60.4 | Remain-der | 0.0 | 0.00 | 1.5 | 0.15 | 0.00 | 0.0 | 0.0 | 0.09 |
| Test piece 70 | 60.6 | 36.3 | 0.2 | 0.01 | 1.5 | 0.19 | 0.08 | 0.0 | 0.0 | 0.09 |
| Compar-ative material 18 | 59.0 | Remain-der | 2.0 | 0.12 | 0.2 | 0.05 | 0.01 | 0.0 | 0.0 | 0.00 |

Example 6-1 (Upset Test)

(1) Test Method

Samples of φ35 mm×30 mm were heated by an electric furnace at each test temperature, and the samples were pressed to a thickness of 6 mm by a 400 t knuckle joint press, and the condition (presence or absence of crack) on the outer periphery of the sample was observed and evaluated. In this case, no crack and wrinkle was evaluated as ○, a small amount of fine cracks or wrinkles was evaluated as Δ, and presence of cracks was evaluated as x.

(2) Test Result

The results of evaluation of the appearance of an upset test piece are shown in Table 46. In the table, test materials 68 and 69 provided good results over a very wide temperature range as compared with a brass rod C3771 for general forging as the comparative material 18. In the test material 70 containing P added, cracks were generated at the lower temperature side of 500° C. to 620° C. and at the higher temperature side of 860° C., however, the results thereof were excellent over a wide temperature range as compared with C3771.

Figure 19:
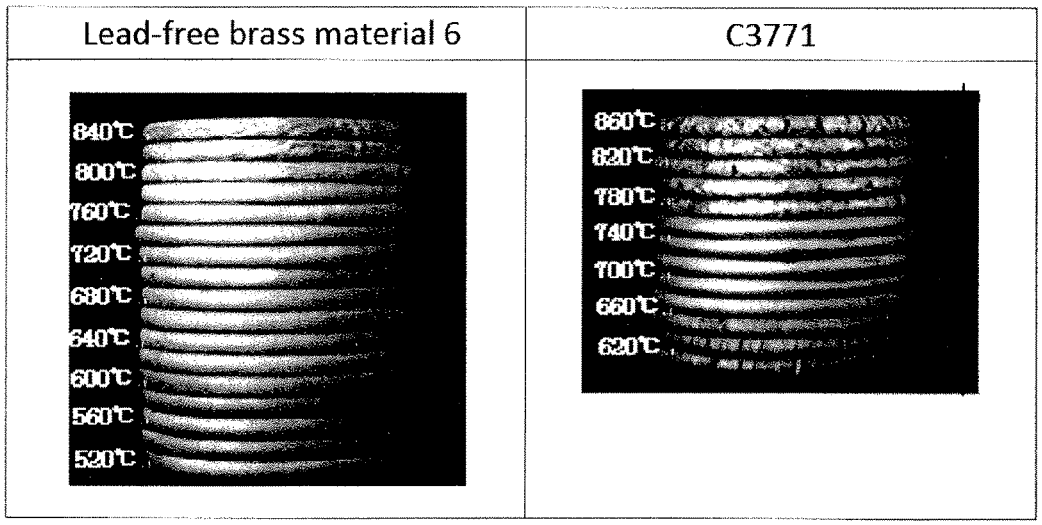
FIG. 19 is a photograph showing the appearance of an upset test piece.

The photographs of the appearance of upset test pieces of the comparative material 18 (C3771) and the test material 69 (lead-free brass material 6) as a typical example of the present invention are shown in FIG. 19.

TABLE 46

| Result of evaluation of appearance of upset test piece | | | | | | | | | |
|---|---|---|---|---|---|---|---|---|---|
| No. | 520° C. | 540° C. | 560° C. | 580° C. | 600° C. | 620° C. | 640° C. | 660° C. | 680° C. |
| Test piece 68 | x | A | ○ | ○ | ○ | ○ | ○ | ○ | ○ |
| Test piece 69 | Δ | ○ | ○ | ○ | ○ | ○ | ○ | ○ | ○ |
| Test piece 70 | x | x | x | x | x | Δ | ○ | ○ | ○ |
| Comparative material 18 | — | — | — | — | — | x | x | x | Δ |
| No. | 700° C. | 720° C. | 740° C. | 760° C. | 780° C. | 800° C. | 820° C. | 840° C. | 860° C. |
| Test piece 68 | ○ | ○ | ○ | ○ | Δ | Δ | Δ | Δ | Δ |
| Test piece 69 | ○ | ○ | ○ | ○ | ○ | Δ | Δ | Δ | — |
| Test piece 70 | ○ | ○ | ○ | ○ | ○ | Δ | Δ | Δ | x |
| Comparative material 18 | ○ | ○ | ○ | ○ | Δ | x | x | — | — |

Example 6-2 (Hot Deformation Resistance Test)

(1) Test Method

A sample of φ10 mm×15 mmL is heated by an electric furnace up to a prescribed test temperature, and a weight of constant load is allowed to fall from given height to apply the load on the heated sample, and deformation resistance is calculated from the thicknesses of the sample before and after the test, and evaluated.

Hot deformation resistance $Kf$ (kg/mm$^2$) =

$$\frac{W \times H}{V \times \ln\left(\frac{ho}{h}\right)} = \frac{7.98(\text{kg}) \times 1013(\text{mm})}{V \cdot \ln\left(\frac{ho}{h}\right)}$$

Here, W represents the weight (kg) of the weight, H represents the falling height (mm) of the weight, V represents the volume (m$^3$) of the sample, $h_0$ represents the height (mm) of the sample before deformation and h represents the height (mm) after deformation.

(2) Test Result

The hot deformation resistance values of the test materials 68 to 70 and the comparative material 18 at respective temperatures are shown in Table 47.

From the results in the table, it was confirmed that the resistance values of all the test materials are suppressed to those somewhat higher than the resistance value of the comparative material (C3771), at any heating temperature.

TABLE 47

| Hot deformation resistance value at each temperature | | | |
|---|---|---|---|
| | 680° C. | 740° C. | 800° C. |
| Test piece 68 | 13.6 | 9.8 | 7.4 |
| Test piece 69 | 13.7 | 9.3 | 7.3 |
| Test piece 70 | 13.4 | 9.2 | 7.4 |
| Comparative material 18 | 11.7 | 8.1 | 6.3 |

EXAMPLE 7

Regarding the mechanical properties of the lead-free brass alloy of the present invention, tests for confirming tensile strength (criterion value: 315 MPa or more), elongation (criterion value: 15% or more) and hardness (80 Hv or more) were carried out.

As the test material and the comparative material, the same test materials 68 to 70 and comparative material 18 as in Example 6 were used.

Example 7-1 (Tensile Strength)

(1) Test Method

As the test piece, a No. 4 test piece is used, and the test method thereof follows JIS Z 2241 "Metalic materials—Tensile testing—Method".

(2) Test Result

The tensile strength of any of the test material 68, the test material 69 and the test material 70 is over the tensile strength of the comparative material 18 (C3771), that is, values not lower than the criterion value of 315 MPa are satisfied.

Example 7-2 (Elongation)

(1) Test Method

As the test piece, a No. 4 test piece is used, and the test method thereof follows JIS Z 2241 "Metalic materials—Tensile testing—Method".

(2) Test Result

The elongation of any of the test material 68, the test material 69 and the test material 70 is lower than the elongation of the comparative material 18, however, values not lower than the criterion value of 15% are satisfied.

Example 7-3 (Hardness)

(1) Test Method

The test method followed JIS Z 2244 "Vickers hardness test—Test method", and hardness was measured around ⅓R from the outer periphery of the cross section of a rod-shaped material. As the criterion of hardness, the criterion of C3604 was used.

(2) Test Result

The hardness of any of the test material 68, the test material 69 and the test material 70 was over the hardness of the comparative material 18, and values not lower than the criterion value of 80 Hv are satisfied.

The results of the tests of mechanical properties regarding tensile strength, elongation and hardness described above are shown in Table 48.

TABLE 48

Result of evaluation of mechanical property

| | Tensile strength (315 MPa or more) | Elongation (15% or more) | Hardness (80 Hv or more) |
|---|---|---|---|
| Test piece 68 | 498 MPa | 20.7% | 149 Hv |
| Test piece 69 | 454 MPa | 21.5% | 115 Hv |
| Test piece 70 | 495 MPa | 22.5% | 157 Hv |
| Comparative material 18 | 400 MPa | 37.7% | 110 Hv |

EXAMPLE 8

For evaluating the anti-erosion-corrosion property of a forged article of the lead-free brass alloy of the present invention, the following gap jet corrosion test (erosion-corrosion corrosion test) was carried out. As the test material and the comparative material, the test material 69 and the comparative material 18 (C3771) described above and the test material 61 shown in Table 49 were used.

TABLE 49

Chemical component value of test material 71 (mass %)

| Material | Cu | Pb | Sn | P | Fe | Ni | Sb | Si | Zn |
|---|---|---|---|---|---|---|---|---|---|
| Test piece 71 | 60.7 | 0.19 | 1.4 | 0.09 | 0.01 | 0.20 | 0.09 | 0.00 | 37.27 |

(1) Test Method

The conditions of the test are shown in Table 50. In the gap jet corrosion test, a nozzle in the form of round disk and a test piece are mutually superposed via an interval of 0.4 mm, and a 40±5° C. test solution (1% cupric chloride aqueous solution) is poured into the gap through a nozzle port having a diameter φ of 1.6 mm provided at the center of the upper disk. The test solution fills the gap and flows radially on the surface of the test piece. The flow rate of the test solution is 0.4 L/min, and the current speed in the nozzle is 3.3 m/sec.

The anti-erosion-corrosion corrosion property was evaluated by mass loss, maximum corrosion depth and corrosion form.

TABLE 50

Test condition

| Item | Condition |
|---|---|
| Test sample | φ16 forged material |
| Test solution | 1% cupric chloride aqueous solution |
| Temperature of test solution | 40 ± 5° C. |
| Flow rate and current speed of test solution | 0.4 L/min, 3.3 m/sec |
| Nozzle caliber | φ1.6 |
| Test period | 5 hrs continuous exposure |

(2) Test Result

The results of the gap jet corrosion test are shown in FIG. 20. From the test results in the figure, it was confirmed that the mass loss and the maximum corrosion depth of the test material 69 and the test material 71 are lowered significantly as compared with the comparative material 18, thus, an excellent anti-erosion-corrosion property is recognized.

It may also be permissible that at least a wetted part of wetted components (plumbing instrument) such as valves, water faucets and the like using the brass alloy of the present invention is washed, for example, by a method described in Japanese Patent No. 3345569, to prevent elution of lead. Specifically, a wetted part is washed with a washing solution prepared by adding an inhibitor to nitric acid, thereby, the surface layer of the wetted part is de-leaded, and simultaneously, a film is formed on the copper surface of the surface layer to suppress corrosion with nitric acid. As the above-described inhibitor, hydrochloric acid and/or benzotriazole is used, and it is preferable that the concentration of nitric acid in the above-described washing solution is 0.5 to 7 wt % and the concentration of hydrochloric acid in the solution is 0.05 to 0.7 wt %.

It may also be permissible that a nickel salt adhered to the surface layer of the wetted part of wetted components (plumbing instrument) such as valves, water faucets and the like on which a nickel plating treatment has been performed using the brass alloy of the present invention is washed, for example, by a method described in Japanese Patent No. 4197269, and the above-described nickel salt is washed and removed via an acid washing process using a washing solution containing nitric acid and hydrochloric acid added as an inhibitor under treatment temperatures (10° C. to 50° C.) and treatment times (20 seconds to 30 minutes) for effective treatment, and a de-nickelification treatment is performed effectively on the surface layer of the wetted part under condition of formation of a film on the surface of the wetted part with the above-described hydrochloric acid. It is preferable that the concentration of nitric acid in the above-described washing solution is 0.5 to 7 wt % and the concentration of hydrochloric acid in the solution is 0.05 to 0.7 wt %.

Further, it may also be permissible that at least a wetted part of wetted components (plumbing instrument) such as valves, water faucets and the like using the brass alloy of the present invention is treated, for example, by a method described in Japanese Patent No. 5027340, to prevent elution of cadmium. Specifically, at least on a wetted part of a copper alloy plumbing instrument containing solid-solved cadmium, a film is formed from an organic substance composed of an unsaturated fatty acid to coat zinc on the surface of the wetted part of this plumbing instrument, thereby suppressing elution of cadmium solid-solved in zinc. As the above-described unsaturated fatty acid, organic substances containing mono-unsaturated fatty acids, di-unsaturated fatty acids, tri-unsaturated fatty acids, tetra-unsaturated fatty acids, penta-unsaturated fatty acids or hexa-unsaturated fatty acids are preferable. As the above-described unsaturated fatty acid, organic substances containing oleic acid as a mono-unsaturated fatty acid or linoleic acid as a di-unsaturated fatty acid are preferable. For oleic acid as a mono-unsaturated fatty acid, it is preferable that 0.004 wt % oleic acid concentration 16.00 wt %. Further, it is recommendable that the above-described plumbing instrument is washed with an acid or alkali solution, then, a film is formed from an organic substance composed of the above-described unsaturated fatty acid.

INDUSTRIAL APPLICABILITY

The brass alloy excellent in recyclability and corrosion resistance of the present invention can be widely applied to various fields requiring machinability, mechanical properties (tensile strength, elongation), a dezincification corrosion resistance, an anti-erosion-corrosion property, casting crack resistance, further, also impact resistance, in addition to recyclability and stress corrosion crack resistance.

Further, it is possible that an ingot is produced using the brass alloy of the present invention, and this is provided as an intermediate product, and the alloy of the present invention is processing-molded, for example, forging-molded, to provide wetted components, building materials, electric parts and machine parts, ship parts, hot water-related equipment and the like.

Suitable members and parts to which the brass alloy excellent in recyclability and corrosion resistance of the present invention is applied as the material are, particularly, wetted components such as valves, water faucets and the like, namely, the brass alloy of the present invention can be applied widely to ball valves, hollow balls for ball valve, butterfly valves, gate valves, globe valves, check valves, valve stems, water supply faucets, mounting hardwares of water heaters, hot water flushing toilet seats and the like, water supply tubes, connecting tubes and tube couplings, refrigerant pipes, electric water heater parts (casing, gas nozzle, pump part, burner and the like), strainers, water piping meter parts, underwater water piping parts, water discharge plug, elbow tubes, bellows, connecting flanges for toilet bowl, spindles, joints, headers, corporation cocks, hose nipples, water faucet-attached metal fittings, waterstop faucets, water supply and drainage delivery tap equipment, sanitary earthen-ware metal fittings, splicing metal fittings for shower hose, gas appliances, architectural materials such as doors, knobs and the like, home electric appliances, adapters for sheath pipe header, automobile cooler parts, fishing tackle parts, microscope parts, water piping meter parts, measuring apparatus parts, railway pantagraph parts, and other members and parts. Further, the brass alloy of the present invention can be widely applied also to toilet supplies, kitchenwares, bathroom goods, restroom supplies, furniture parts, living room supplies, sprinkler parts, door parts, gate parts, automatic vending machine parts, washing machine parts, air conditioner parts, gas welding machine parts, heat exchanger parts, solar water heater parts, molds and parts thereof, bearings, gears, construction machinery parts, railway vehicle parts, transportation equipment parts, materials, intermediate products, end products, assemblies, and the like.

The invention claimed is:

1. A brass alloy consisting of 58.0 to 61.9 mass % of Cu, 1.0 to 2.0 mass % of Sn, 0.05 to 0.29 mass % of Sb, 0 to 0.3 mass % of Pb, 0 to 0.3 mass % of Bi, and a remainder of Zn and unavoidable impurities, wherein the brass alloy is recyclable with a copper alloy containing Pb or Bi, prevents embrittlement by a Pb—Bi eutectic crystal, and exhibits excellent machinability and stress corrosion crack resistance.

2. A brass alloy consisting of 58.0 to 61.9 mass % of Cu, 1.1 to 2.0 mass % of Sn, 0.05 to 0.29 mass % of Sb, 0 to 0.3 mass % of Pb, 0 to 0.3 mass % of Bi, 0.05 to 1.5 mass % of Ni to generate interaction between the Ni and Sb thereby suppressing segregation of Sn and Sb in a γ-phase to improve stress corrosion crack resistance, and a remainder of Zn and unavoidable impurities, wherein the brass alloy is recyclable with a copper alloy containing Pb or Bi, and prevents embrittlement by a Pb—Bi eutectic crystal.

3. The brass alloy according to claim 1 or 2, wherein said Sb is contained at a content of 0.05 to 0.15 mass %, and stress corrosion crack resistance is excellent while reducing the content of the Sb.

4. The brass alloy according to claim 2, wherein said Ni is contained at a content of 0.10 to 0.25 mass %, and lowering of hot ductility is prevented while ensuring stress corrosion crack resistance.

5. A processed part obtained by processing-molding the brass alloy according to claim 1 or 2 to be used in a processed part.

6. A wetted part comprising the brass alloy according to claim 1.

7. The wetted part according to claim 6, which is a valve or water faucet.

8. A wetted part comprising the brass alloy according to claim 2.

9. The wetted part according to claim 8, which is a valve or water faucet.

* * * * *